US005678482A

United States Patent [19]

Daniel et al.

[11] Patent Number: 5,678,482

[45] Date of Patent: Oct. 21, 1997

[54] SEQUENCING METHOD FOR PRINTING MACHINE

[75] Inventors: Robert P. Daniel; Boguslaw S. Biel, both of Carol Stream, Ill.

[73] Assignee: M&R Printing Equipment, Inc., Glen Ellyn, Ill.

[21] Appl. No.: 727,251

[22] Filed: Oct. 8, 1996

Related U.S. Application Data

[62] Division of Ser. No. 328,666, Oct. 25, 1994, Pat. No. 5,595,113.

[51] Int. Cl.[6] ..... B41M 1/12

[52] U.S. Cl. ..... 101/129; 101/115

[58] Field of Search ..... 101/115, 123, 101/126, 129

[56] References Cited

U.S. PATENT DOCUMENTS

| | | | |
|---|---|---|---|
| 4,099,460 | 7/1978 | Bubley et al. | 101/44 |
| 4,434,562 | 3/1984 | Bubley et al. | 34/4 |
| 4,813,351 | 3/1989 | Pierson, Jr. | 101/115 |
| 4,964,335 | 10/1990 | Klemm | 101/129 |
| 4,982,694 | 1/1991 | Moriyama | 118/692 |
| 5,090,311 | 2/1992 | Brasa . | |
| 5,136,938 | 8/1992 | Pellegrina | 101/115 |
| 5,154,119 | 10/1992 | Fuqua et al. | 101/115 |
| 5,188,026 | 2/1993 | Fuqua et al. | 101/129 |
| 5,195,434 | 3/1993 | Hoffmann | 101/126 |

FOREIGN PATENT DOCUMENTS

| | | |
|---|---|---|
| 0097629 | 4/1984 | European Pat. Off. . |
| DT2718635 | 11/1978 | Germany . |
| 2 068 836 | 8/1981 | United Kingdom . |

OTHER PUBLICATIONS

Western Electric Technical Digest No. 38, "Air Logic Circuit for Sensing the Position of an Article Upon a Support," F.E. Robbins, Apr., 1975, pp. 37,38.

Sales Brochure of CHAMPRINT™ Automatic Textile Printer of Advance American Equipment.

Sales Brochure of American M&M Triumph Mid-size Automatic Textile Printer, pp. 6–7.

Sales Brochure of American AL-X Multicolor Textile Printer, pp. 8–9.

Sales Brochure of American M&M's Centurian™ Automatic Textile Printer, pp. 12–13.

Sales Brochure of TAS Automatic Screen Printing Equipment.

Sales Brochure of Firma MHM Synchroprint 2000.

Sales Brochure of Siasprint Group, "SIAS Experience".

*Primary Examiner*—Christopher A. Bennett

[57] ABSTRACT

A sequencing system for a printing press, the printing press having a plurality of print stations, each of the print stations for printing a respective portion of a design on an item with ink, the printing press also having a curing station for curing the printed ink, the sequencing system comprising a controller having random access memory for selecting one of the print stations, for selecting one of the print stations, for indexing the item to the selected print station, for determining whether the item is present at the selected print station, for actuating the selected print station to print the respective portion of the design on the item, determining completion of the actuation, for selecting one of the curing stations, for indexing the item to the selected curing station, for determining whether the item is present at the selected curing station, for actuating the selected curing station, and for determining completion of the curing operation.

41 Claims, 38 Drawing Sheets

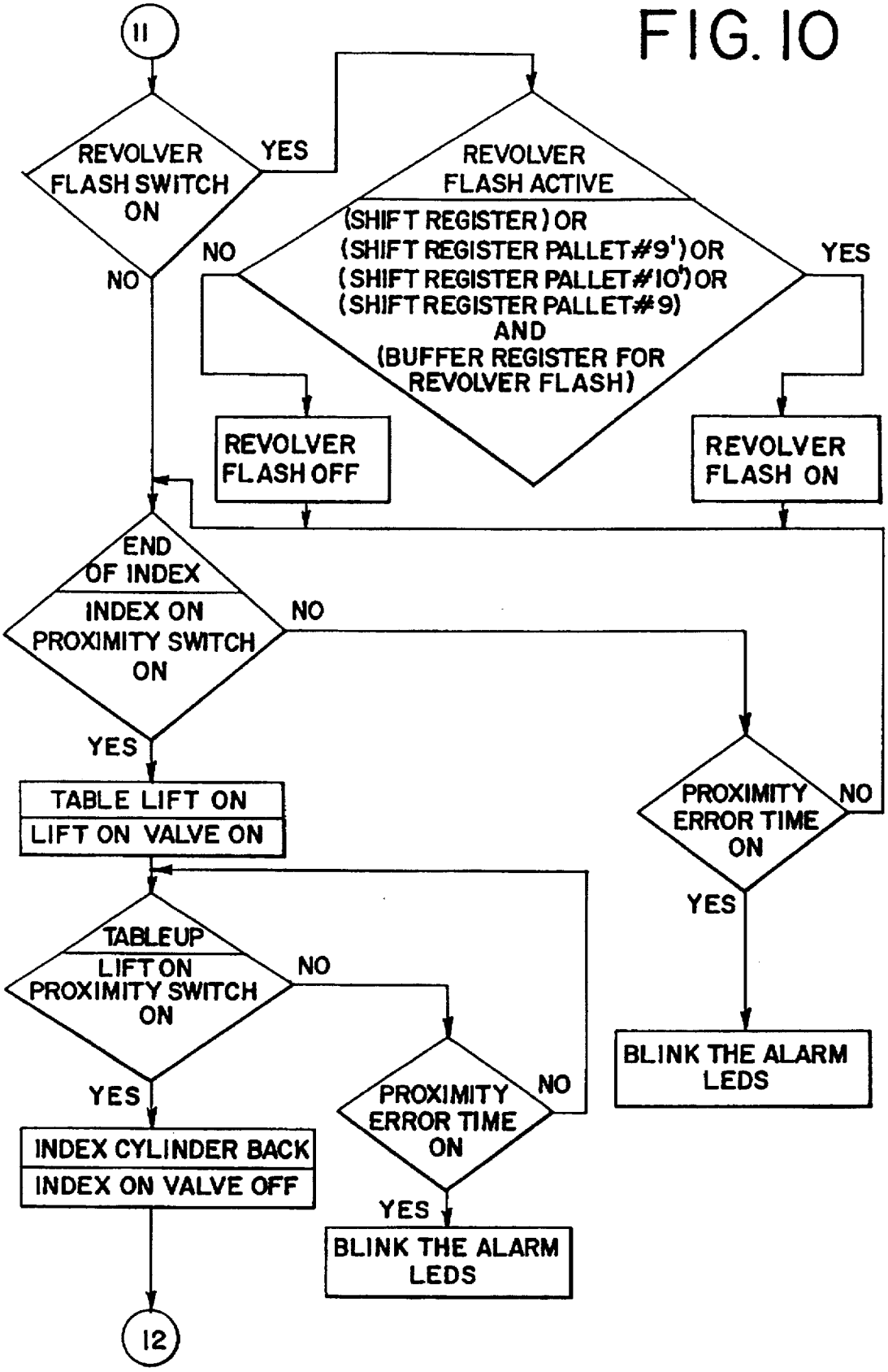
FIG. 10
11
REVOLVER FLASH SWITCH ON
YES
NO
REVOLVER FLASH ACTIVE
(SHIFT REGISTER) OR
(SHIFT REGISTER PALLET#9') OR
(SHIFT REGISTER PALLET#10') OR
(SHIFT REGISTER PALLET#9)
AND
(BUFFER REGISTER FOR REVOLVER FLASH)
NO
YES
REVOLVER FLASH OFF
REVOLVER FLASH ON
END OF INDEX
INDEX ON PROXIMITY SWITCH ON
NO
YES
TABLE LIFT ON
LIFT ON VALVE ON
PROXIMITY ERROR TIME ON
NO
YES
BLINK THE ALARM LEDS
TABLE UP
LIFT ON PROXIMITY SWITCH ON
NO
YES
INDEX CYLINDER BACK
INDEX ON VALVE OFF
PROXIMITY ERROR TIME ON
NO
YES
BLINK THE ALARM LEDS
12

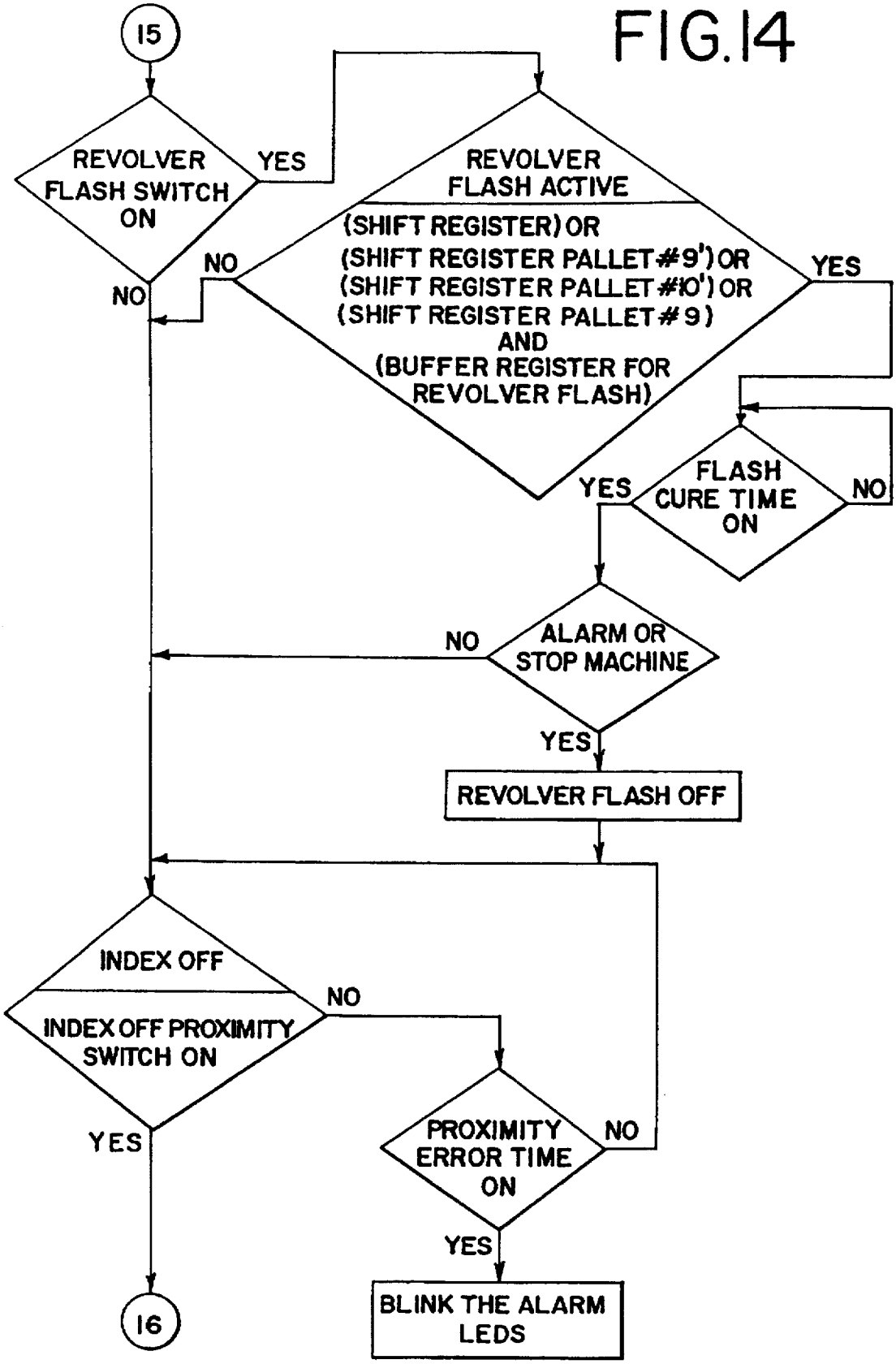
FIG.14
15
REVOLVER FLASH SWITCH ON
YES
NO
REVOLVER FLASH ACTIVE
(SHIFT REGISTER) OR
(SHIFT REGISTER PALLET #9') OR
(SHIFT REGISTER PALLET #10') OR
(SHIFT REGISTER PALLET # 9)
AND
(BUFFER REGISTER FOR REVOLVER FLASH)
NO
YES
FLASH CURE TIME ON
YES
NO
ALARM OR STOP MACHINE
NO
YES
REVOLVER FLASH OFF
INDEX OFF
INDEX OFF PROXIMITY SWITCH ON
NO
YES
PROXIMITY ERROR TIME ON
NO
YES
BLINK THE ALARM LEDS
16

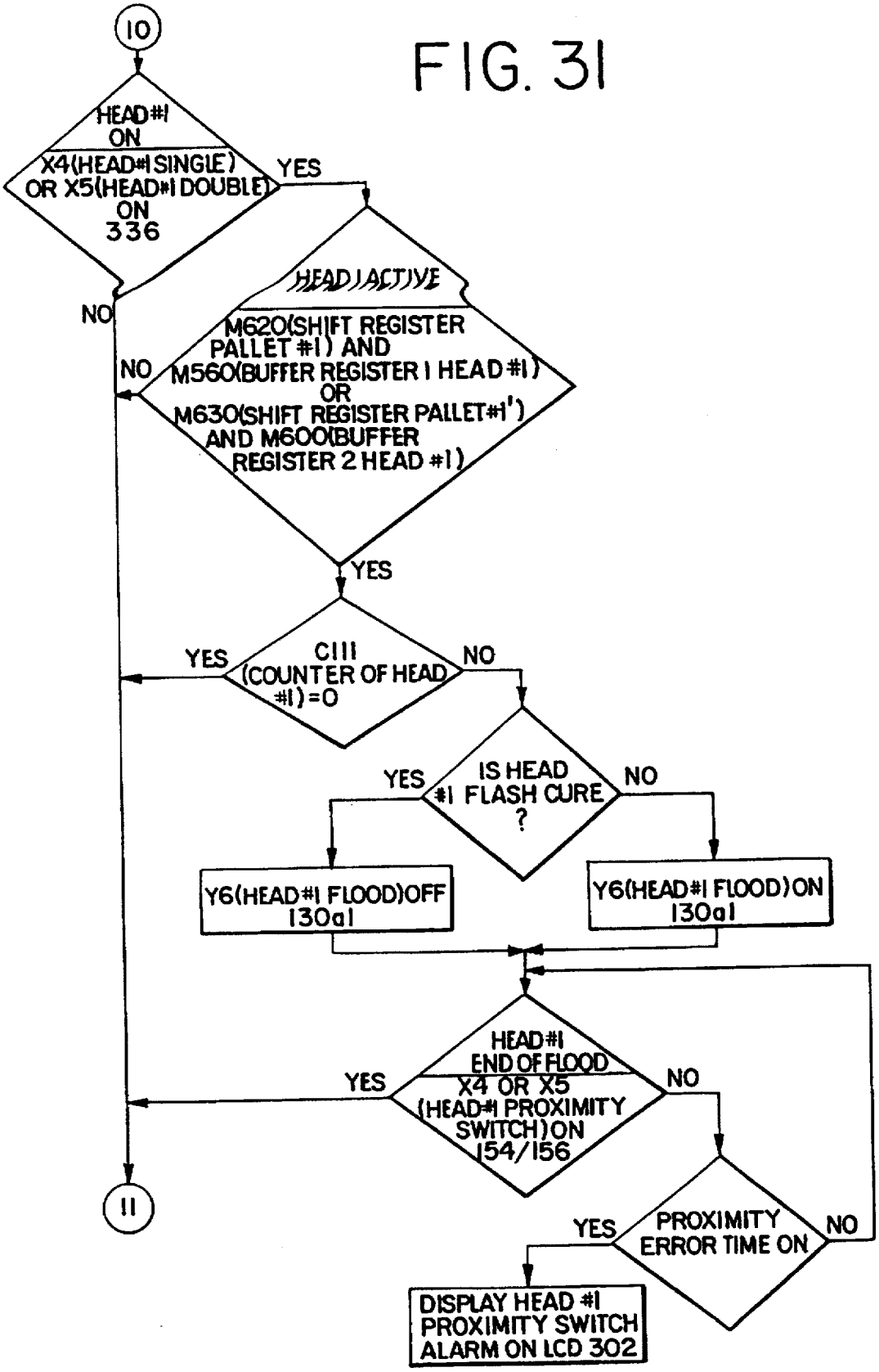
FIG. 31
10
HEAD #1 ON
X4(HEAD#1 SINGLE) OR X5(HEAD#1 DOUBLE) ON
336
YES
NO
HEAD ACTIVE
M620(SHIFT REGISTER PALLET #1) AND M560(BUFFER REGISTER 1 HEAD #1) OR M630(SHIFT REGISTER PALLET#1') AND M600(BUFFER REGISTER 2 HEAD #1)
NO
YES
C111 (COUNTER OF HEAD #1)=0
YES
NO
IS HEAD #1 FLASH CURE ?
YES
NO
Y6(HEAD#1 FLOOD)OFF 130a1
Y6(HEAD#1 FLOOD)ON 130a1
HEAD#1 END OF FLOOD
X4 OR X5 (HEAD#1 PROXIMITY SWITCH)ON 154/156
YES
NO
11
PROXIMITY ERROR TIME ON
YES
NO
DISPLAY HEAD #1 PROXIMITY SWITCH ALARM ON LCD 302

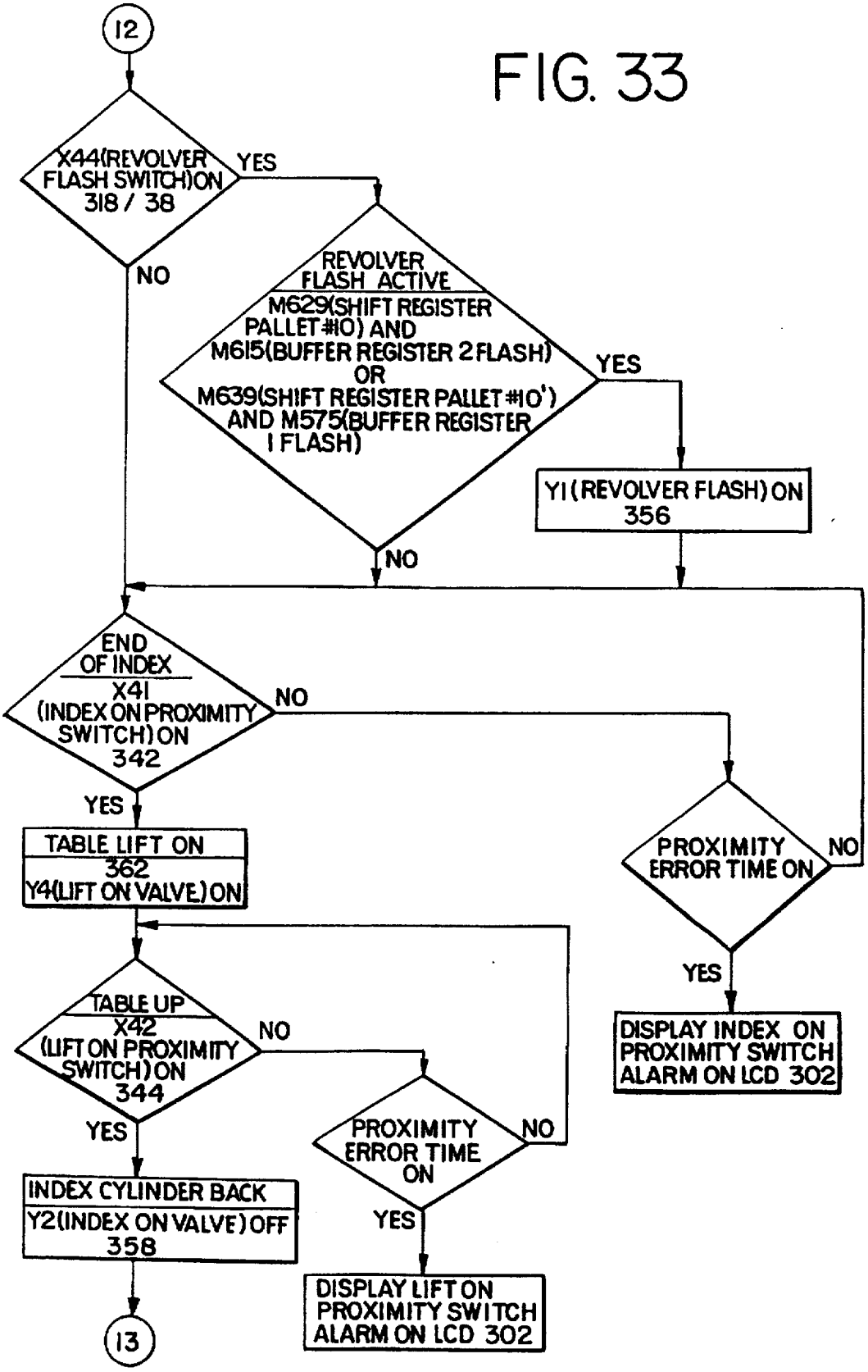
12
FIG. 33
X44(REVOLVER FLASH SWITCH)ON 318 / 38
YES
NO
REVOLVER FLASH ACTIVE
M629(SHIFT REGISTER PALLET#10) AND M615(BUFFER REGISTER 2 FLASH) OR M639(SHIFT REGISTER PALLET#10') AND M575(BUFFER REGISTER 1 FLASH)
YES
NO
Y1 (REVOLVER FLASH) ON 356
END OF INDEX
X41 (INDEX ON PROXIMITY SWITCH) ON 342
NO
YES
TABLE LIFT ON 362
Y4(LIFT ON VALVE) ON
PROXIMITY ERROR TIME ON
NO
YES
DISPLAY INDEX ON PROXIMITY SWITCH ALARM ON LCD 302
TABLE UP
X42 (LIFT ON PROXIMITY SWITCH) ON 344
NO
YES
PROXIMITY ERROR TIME ON
NO
YES
INDEX CYLINDER BACK
Y2(INDEX ON VALVE) OFF 358
DISPLAY LIFT ON PROXIMITY SWITCH ALARM ON LCD 302
13

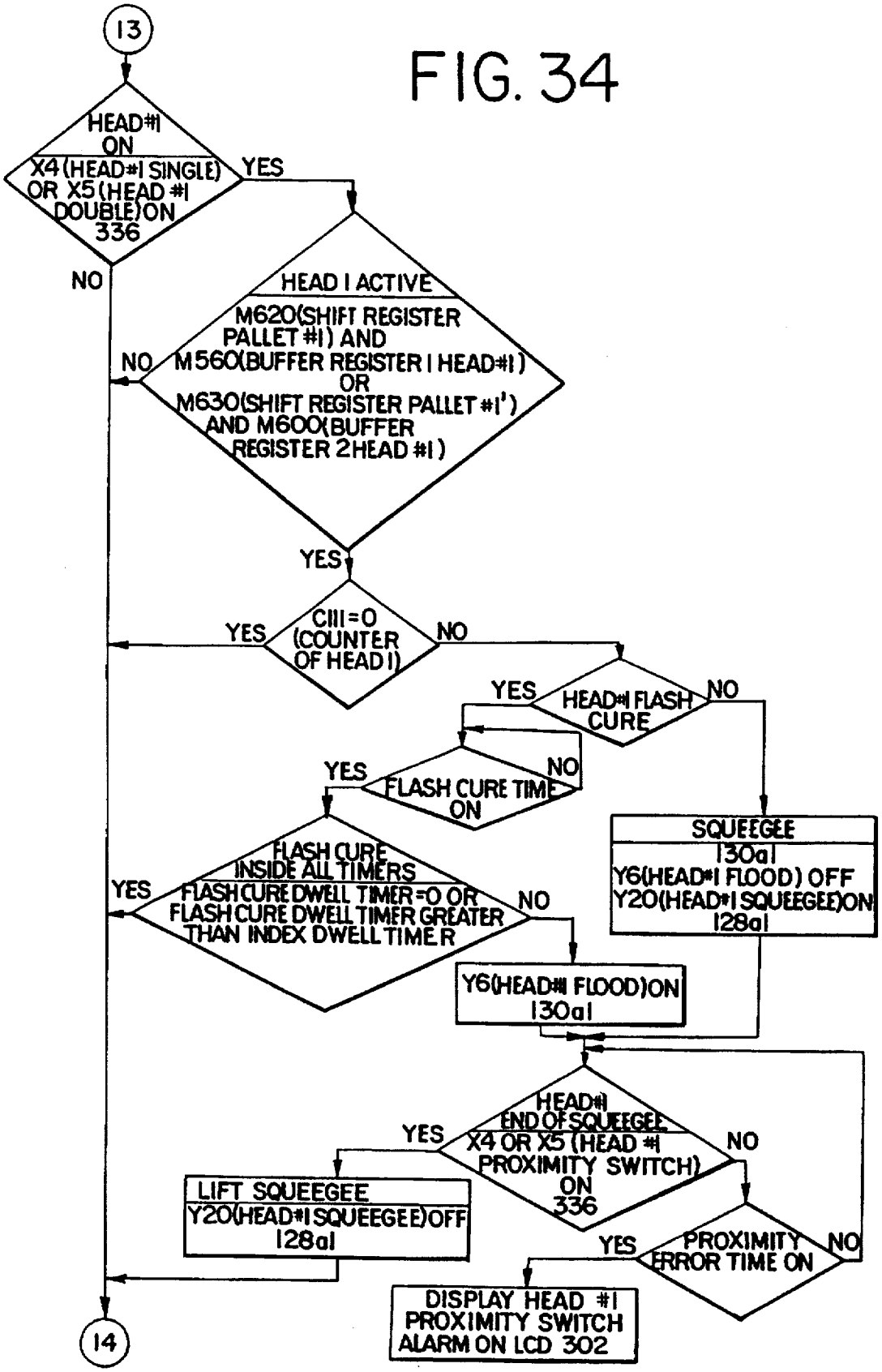
13
FIG. 34
HEAD#1 ON
X4 (HEAD#1 SINGLE) OR X5 (HEAD #1 DOUBLE) ON
336
YES
NO
HEAD I ACTIVE
M620(SHIFT REGISTER PALLET #1) AND
M560(BUFFER REGISTER I HEAD#1) OR
M630(SHIFT REGISTER PALLET #1') AND M600(BUFFER REGISTER 2HEAD #1)
NO
YES
CIII=0 (COUNTER OF HEAD I)
YES
NO
HEAD#1 FLASH CURE
YES
NO
FLASH CURE TIME ON
YES
NO
FLASH CURE INSIDE ALL TIMERS
FLASH CURE DWELL TIMER=0 OR FLASH CURE DWELL TIMER GREATER THAN INDEX DWELL TIMER
YES
NO
SQUEEGEE
130a1
Y6(HEAD#1 FLOOD) OFF
Y20(HEAD#1 SQUEEGEE)ON
128a1
Y6(HEAD#1 FLOOD)ON
130a1
HEAD#1 END OF SQUEEGEE
X4 OR X5 (HEAD #1 PROXIMITY SWITCH) ON
336
YES
NO
LIFT SQUEEGEE
Y20(HEAD#1 SQUEEGEE)OFF
128a1
PROXIMITY ERROR TIME ON
YES
NO
DISPLAY HEAD #1 PROXIMITY SWITCH ALARM ON LCD 302
14

SEQUENCING METHOD FOR PRINTING MACHINE

This is a divisional of application Ser. No. 08/328,666 filed on Oct. 25, 1994, now U.S. Pat. No. 5,595,113.

DESCRIPTION

1. Technical Field of the Invention

The present invention relates to the field of printing. More specifically, the present invention relates to an automated printing press for sequencing, printing, and curing ink on articles or items.

2. Background of the Invention

Printed indicia which are applied to T-shirts and other articles of clothing have become very popular in the last decade. Boutiques which specialize in selling fanciful indicia, such as slogans, college names or sports team names printed on T-shirts and other clothing, are commonly seen in shopping malls. The indicia available at these boutiques can be applied directly to an article of clothing.

Multi-station, turret-type, printing presses are commonly used in the industry to print articles. The printing press of this type has a plurality of flat beds spaced radially along its perimeter. Corresponding to each of these beds is a series of stations whereat the article is either printed or cured. In the prior art, the number of stations employed depended upon the number of colors to be printed. Printing indicia on the articles can consist of ten colors or more for complicated designs. Only one color can be printed per station and printing usually requires some form of curing after each color is printed.

At the initial station of prior printing presses, the article is printed on the flat bed. The bed is typically made of metal such as aluminum or stainless steel. A screen embodying at least a portion of the indicia design to be printed is premade using any conventional means that is well-known in the art. The indicia or design is formed in the screen by a conventional process. The screen has interstices in the places where ink of a particular color is to be deposited onto the article. For each color, a different stencilled screen is used.

To print the indicia onto the article with the colored ink, the article is placed flat on the bed by the operator or an automatic feed. Once printed with the first color, the article must not shift reference or it will be out of registration with the other stations which print the remaining colors. The alignment between the beds and the heads at each station is generally known to one of ordinary skill in the art.

The bed which is carrying the article moves to a station that is set up for printing. After ink of one color is manually placed onto the screen, the colored ink is then flooded onto the screen with a flooder that is connected to a flood bar. The flooder moves across the face of the screen and smears the ink across the screen face in the process. Once the ink is smeared or flooded across the face of the screen, the bed then rises up to the stationary screen with the article sandwiched between the screen embodying the indicia design and the bed carrying the article. A squeegee is then used to squeegee or force the ink through the screen where the indicia design (interstices) exists on the screen. The squeegee performs the squeegeeing function by moving back across the face of the screen in the opposite direction than the flooding. This type of printing on an article is well known in the art. The ink used is also of a type that is well-known in the industry. In addition, the flooders and squeegees used are generally well-known in the art.

After the ink is squeegeed through the screen onto the article, the beds are lowered, and the turret-type press containing the beds is rotated to allow the bed to index to the next station where the ink is again smeared onto the article. Some types of ink require gelling or curing. The ink is cured on the article by any means such as irradiate heating, ultraviolet (UV), or infrared flash curing it to a critical temperature. Heat is commonly applied by a heat curing source directed toward the bed and article. Heat curing can include curing with UV light or infrared (flash curing) which is well-known in the art. The temperature during the curing process must be kept within a window suitable for the ink-curing or gelling conditions, typically around 200° F. The bed, as it is made of metal, tends to act as a heat sink, retaining heat from the successive curing steps. If the temperature of the bed or article is allowed to go too high, the ink has a tendency to scorch or burn, thereby ruining the article and increasing waste and production costs. Furthermore, if the temperature is allowed to go too high, the ink will over-gel, also ruining the article. If the temperature is too low, the ink will not cure properly, and will not adhere to the article and may adhere to the screen at the next print station. The ink on the article must also be cured and dried uniformly. If it is not, there will be irregularities and the ink will have a tendency to peel off of the article at the irregularities. The above printing process is repeated several times, depending on the number of colors required, in a sequence that is programmed by a user into an operator panel.

Using inks which require curing typically requires a curing station for each printing station. The curing station would be located adjacent to each printing station. This takes up valuable space in a production facility by requiring presses to have double the number of stations as colors, if curing is required for each color used. It may also require the purchase of multiple curing units, one for each printing station on some types of printing presses.

One prior printing press configuration has included the previously listed features as well as further details that limit an operator in programming how the sequencing will take place. In order to fully explain the sequence programming of the previous printing press, a description of one embodiment of a known printing press will follow. This system comprises a multi-station, turret-type printing press. The printing press is of a type conventional in the art. The printing press consists of a series of beds spaced along its perimeter radiating outward from its center. The beds can be made of metal such as aluminum or steel. Corresponding to the beds are a series of stations. The stations are designed to imprint articles with ink. The construction of print stations are generally known in the art and typically consist of a flood bar with flooder and squeegee bar with squeegee arrangement. In the center of the press is a conventional motor or valve assembly to rotate and index the beds between the stations. The previous press also has a loading station and an unloading station.

During operation, the turret-type press rotates in a single direction, usually counterclockwise. The general operation of the turret-type press is well-known in the art. A separate curing unit is placed at the unload station of the printing press. The curing unit is preferably a flash curing unit. Flash curing units are well-known in the art and flash the article with infrared light.

The prior sequencing system of the previous printing press limits the operator selecting which print stations will be used to perform the printing task at hand and in what sequence they will operate. The operator is also limited in the automatic and manual control of curing the ink on the article to be printed after each printing step when desired.

Operation of one prior sequencing system of a previous printing press is disclosed in FIGS. 1 through 15. FIGS. 1 through 15 are flow charts of the previous printing press control program that runs on a controller, and it will be explained below along with the necessary structure. Several problems and disadvantages exist with this previous control program and structure. FIG. 1 begins with the control program allowing the operator or user to delete or modify the operator program. If the old program is not deleted or modified, the operator program previously entered begins to run. If the operator wants to change the operator program, the control program allows the operator to modify one or more cycles within the operator program (job). A cycle is one revolution of the beds around the printing press while remembering that the printing press can only rotate in one direction. The previous printing press allowed a user to enter up to eleven cycles in the operator program (job) on a printing press with eight total stations. However, one significant problem with the previous printing press is that only one operator program could be stored in the controller at one time. Thus, if an operator needed to make dramatic changes in the operator program for automated control, the operator would effectively have to re-program the controller each time the operator program needed to be changed. This is significant because re-programming takes up valuable run time which could otherwise be used for printing items.

Continuing with FIG. 1, if a user wanted to erase the old job, the heads (stations) stored as active and the heads printing in double mode in the old operator program were reset. If the old program was not erased or a new job was to be entered, a rotatable thumbwheel was used to set which cycle number was to be changed or added. For that cycle number, each head (station) is set to either active or inactive, and these states are stored in random access memory.

Next, for each cycle and each head in each cycle in the prior sequencing system, the heads need to individually be set for printing in single or double print mode, single print mode being one flood stroke with one squeegee stroke, and double print mode being one flood stroke with one squeegee stroke and then another flood stroke with another squeegee stroke. In order to set these states for printing heads (stations) for each head and cycle, single/double/off switches are provided for each head on an operator control panel. However, there is no means provided to switch the curing heads to inactive without re-entry of the operator program (job). This is another significant problem with the previous printing press. Specifically, when an operator is running the printing press in automatic (revolver) mode and the operator wants to deactivate a curing station that has been set up as an active head (station), the operator cannot deactivate the curing head without reprogramming the entire job. Thus, valuable production time is lost during this down time and makes the prior printing press design more costly to run and less efficient. In addition, a further disadvantage with the prior sequencing system is that the flash cure information was not stored in battery backup locations. Thus, every time the printing press was powered down, the information for which heads were set up as flash cure heads was lost and the operator needed to reprogram this information. This took time and kept the printing press off-line and was a significant disadvantage with the owners and users.

The programming of the heads being active or inactive for printing, and printing in single or double mode is completed in FIG. 2. Thereafter, the operator must program whether the flash cure at the unload station (revolver flash) is active for each cycle. Operator programming either then continues with more cycles and head configuration for printing, or the operator sets up the heads that will operate as flash cure heads (besides the revolver flash). This set up sequence contributes to the previously mentioned problems with turning of a flash cure head during automated operation and is a significant disadvantage because the old program does not allow the operator to turn off a flash cure unit without reprogramming the cycle.

FIG. 3 depicts the prior sequence with the control program taking the operator program (job) and running it upon startup by an operator. The control program was set to run the first cycle and the even cycle register in memory was set to odd for later use. The information for the present cycle was then moved from its normal position in RAM (random access memory) to a global position in RAM. This information included heads (stations) active in the present cycle and the heads that were printing in double mode. Once the information of the present cycle was stored in the global (GBL) RAM area, the cycle number was incremented by one in a cycle register (memory).

Referring to FIG. 4 of the prior sequencing system, a general check for the status of the cycles is performed. If there are no active heads in the next cycle, the present cycle is the last cycle. If this is the case, and the present cycle is half over, and audible alarm is sounded to notify the operator to come back to the printing press for unloading. The lap counter is the position of the beds within a cycle relative to where the beds started at the beginning of that cycle. For a printing press that contained ten stations, one full lap would equal a lap counter value of ten. The revolver flash is then put into a buffer register for the revolver flash later in the sequence.

As previously mentioned, an even cycle register existed to check the even/odd status of the present cycle. This will now be explained. Referring additionally to FIG. 38 (the present invention), a similar buffer and register configuration from the previous printing press design is used. A first buffer BR1 (even cycle buffer) and a second buffer BR2 (odd cycle buffer) are disclosed for storing the information for the even and odd cycles, respectively. A shift register is used to keep track of the position of the beds during each of the cycles (lap counter value in relation to bed position). As FIG. 4 discloses, if the cycle is odd, the active/inactive head information for the present cycle will be placed into BR1. Likewise, if the cycle is even, the active/inactive head information for the present cycle will be placed into BR2.

Thus, information for two cycles will be in BR1 and BR2 for the circumstance when some of the heads are operating within one cycle while the other heads are operating within another cycle. It is easily understood that not more than two cycles will be operating at the same time. These buffers and register will be described in further detail below.

Referring to FIG. 5, an emergency stop button will be continuously checked along with a safety circuit along the perimeter of the printing press. If there is an indication of these safety features not being in the safe condition, the machine will stop and an alarm indicator will appear on the operator control panel. An index on proximity switch (detector), which is well known in the art, existed on the base structure to check if the beds were positioned correctly underneath the heads or stations and to check if the beds were in the down position. If not, then a timer aligned until the correct alignment existed or it would time out into an alarm mode. If the correct rotation alignment existed, then an index off proximity switch is checked to see the indexing valve is in the correct position. If the index off proximity switch was off, then a timer starts which would time out into alarm mode if enough time passes without the beds moving to the down position. Once the alignment in both the rotational and vertical orientation is correct, the beds are indexed by turning the index on valve on which rotates the beds in one (usually counterclockwise) direction.

Referring to FIG. 6 of the prior system, the shift register is then shifted right to keep track of the position of the beds within the cycles currently placed into the buffer registers BR1, BR2. Next, the control program checks which of the heads (stations) are set up in the operator program to operate as double print mode. Double print mode strokes the flood bar, strokes the squeegee, and then repeats the flood and squeegee again. Double print mode heads will create head counter values of two and non-double print mode heads will create head counter values of one for either single print mode heads or curing heads. Once the head counters are set to their respective values, a one is then placed into the eighth pallet position (the pallet which first started in the loading station) to keep track of the positions of the pallets or beds for the relevant cycles (see FIG. 38). The eighth pallet position register (shift register pallet) location used will depend on whether the current cycle is an odd cycle or an even cycle. If even, the eighth prime shift register pallet will be set to one. If odd, the eighth shift register pallet will be set to one. The lap counter is then incremented by one to keep track of the position of the bed (pallet) wheel around the printing press for the current cycle.

Referring to FIG. 7 of the prior system, the checks for each head begin and an additional major problem with the previous printing press sequencing system is realized. Specifically, head one cannot operate as a curing station and the flow chart does not include such a curing operation. Likewise, as will be described below, the last head cannot operate as a flash cure station either. A check of whether the first head is active is performed by checking position one of the shift register and the two buffer registers. If the head is active, and the counter for head one is not zero and head one is set up as single or double print mode, then a flood stroke is performed for head one and ink is flooded over the silk screen. One additional problem with the prior system is that only one proximity switch is provided for each head. Specifically, a proximity switch (detector) is placed on the head portion of each head, and metal contacts were placed at each end of the stroke. Only providing one proximity switch limited the operator in the size of design being printed on the items. Specifically, a user could not change the length of the stroke when only one proximity switch was used. This significantly limited the operator and/or owner in the types of designs that could be created on the press. Thus, as disclosed at the bottom of FIG. 7, the proximity switch will indicate the end of the flood stroke, but will not allow the stroke length to be changed, a significant disadvantage of the prior system. A timer would create an alarm condition upon timeout.

Referring to FIG. 8 of the prior system, a head two active/inactive check is performed. If head two is active and the head two counter is not zero, either flooding of ink across the silk screen will occur, or one of several error conditions will occur. Alternatively, if the head is not active, flash curing will occur if flash curing is set for head two. Thus, a previously mentioned problem is encountered. Flash curing will always take place if the head is set up to operate as a flash curing unit. No manual override can prevent the flash curing at the head. The operator must stop the printing press to re-program the job without the head operating as a curing head. Similar checks for alarm conditions and the end of the flood stroke are performed for head one as for head two.

Heads three through seven operate the same as head two as FIG. 9 denotes with a broken line for these stations. FIG. 9 also discloses a previously mentioned problem of the last head not being capable of operating as a curing head. The operation of head eight is, thus, similar to the operation of head one.

FIG. 10 first discloses the operation of a curing station at the unload station (revolver flash curing station). When the control panel flash on/off switch is on, the revolver flash will be set on if the buffer and register values indicate an active value. Once the revolver curing is checked, indexing up is checked. If the proximity switch for revolutions (index on proximity switch/detector) is on (the beds are properly underneath the heads), the table or bed wheel is then lifted into the up position. When the up/down proximity switch/detector is on, the indexing cylinder which rotates the bed wheel is brought back to receive the next bearing underneath the next pallet or bed on the bed wheel. Error time alarms were also provided. The printing press sequencing was now ready for the squeegee operation.

FIG. 11 of the prior system begins by again checking if head one is active. If head one is active and the head counter for head one is not zero, and head one is on, then the flooder is raised, the squeegee is lowered, and the squeegee then moves across the face of the silk screen to press the ink through the interstices within the screen and onto the item. When the squeegee is at the end of the stroke (the proximity switch is on), the squeegee is then lifted off of the silk screen. A time out alarm is again provided for the proximity switch. Again, head one cannot operate as a flash cure station in the previous printing press.

FIG. 12 of the prior system discloses the squeegee or curing operation for head two. If head two is active and head two counter is not zero, the squeegee operation will take place as in FIG. 12 if head two is on. Otherwise the system will move onto the next head or go into one of several error modes. Heads three though seven then operate the same as head two.

FIG. 13 of the prior system discloses the operation of head eight, which was the same as the operation of head one. The control program checks if revolver curing station (unloading station) is being operated and checks if it had completed or if an alarm or stop had been received by the controller within FIG. 14 of the prior system. Indexing was then continued by checking if the index off proximity switch is on (the correct position of the indexing cylinder).

Referring to FIG. 15 of the prior system, if the up/down proximity switch was on, then the bed wheel or table was lowered and all of the head counters were decremented by one. If any one of the head counters was greater than one at this point, at least one of the heads was set up as double print mode and another flooding and squeegeeing operation was needed to be performed for those heads. The table would then be raised for those double print heads before the strokes occur. If all head counters were zero, printing complete for this position, the lap counter was then checked to see if the cycle was over. If the lap counter was less than ten and the system was still set on automatic mode, the system then began the next position within the current cycle. Otherwise, if the counter was equal to ten, the present cycle was complete and the active heads were reset for the present cycle. The even cycle on was then set odd if even and set even if odd for movement of the appropriate cycle information into the appropriate buffer register as the flow chart disclosed in conjunction with FIG. 38. The sequencing then continued on. For short multi-color production runs, automatic presses are not necessarily the most efficient means of production. Short production runs are often made using manual presses. Manual presses have their own problems. Manual presses are very labor-intensive and require large amounts of setup time. To set up manual presses also requires a highly trained individual. Each screen must be put in registration separately. Each color may be printed on separate manual presses requiring purchase of many presses. Individual manual stations take up valuable floor space. A manual configuration also requires multiple flash or ink curing units. Thus, valuable time is wasted waiting for the screen and ink to cool.

An additional disadvantage of the prior system is that every time the printing press was shut down, the heads would always return to the inner or rear position. Not only the printing heads would return to the rear position, but the curing heads would return or be positioned at the rear position. The flash curing stations typically operate at temperatures upward of 200° F. Thus, when the press was powered down, a potential fire hazard existed or at least heat damage would occur to the pallets because the flash curing unit would be sequenced over the pallet instead of in the front position. The sequencing system of the present invention solves these, the previously mentioned, and other problems.

SUMMARY OF THE INVENTION

It is an object of the present invention to provide a printing press comprising a plurality of stations, each of the stations being capable of working as a print station for printing a respective portion of a design on an item with ink. The printing press stations are also capable of operating as curing stations for curing the ink on the items that was printed by the printing stations. The sequencing system within the printing press comprises a computer or process controller for controlling the operation of the sequencing system which includes push buttons and switches for manually controlling the operation of each station and program with the controller for automatically controlling the operation of each station. The controller is attached to a control panel, and the panel includes an LCD display and an input control keypad, as well as switches and pushbuttons for receiving a set of instructions from an operator. The set of instructions automatically sequences the sequencing system.

It is a further object of the present invention to provide control panel/station manual switches which can prevent a curing station from operating during automatic sequencing without re-entering a new set of instructions for sequencing when the curing station is set to operate during automatic sequencing. The control panel comprises a liquid crystal display for displaying the active and inactive stations or heads. In addition, the control panel is adapted to receive from the user one set of instructions for a set of cycles, and the display then displays the active and inactive stations within each cycle during operation and during setup/programming.

The process controller of the present invention includes a random access memory and control program that allows the controller to receive from the operator more than one set of instructions (jobs) and store the instructions in the random access memory. The program within the controller is also adapted to allow the operator to choose one stored set of instructions (a job) for automatic sequencing of the printing press. The controller is also adapted to receive from the operator more than one set of instructions and store the instructions in the controller memory. Thus, the control program also allows the operator to choose one of the stored sets of instructions (one of the stored jobs) for automatic sequencing of the printing press.

Each printing station or head comprises a head assembly for printing ink onto the item. The head assembly is adapted to move from a first print position to a second print position and adapted to move from the second print position to the first print position. The head assembly is also adapted to start either from the first position or the second position. These positions can be selected from a plurality of front/rear switches, each front/rear switch being adapted to place the printing means at each printing station either in the first position or in the second position. These switches are used to program the controller as well. The print stations also include an adjustment apparatus for adjusting these first and second positions as can be achieved when two proximity switches are used on the head portion.

Each curing station includes flash or heat curing apparatus for curing the ink on the item. The curing apparatus is also adapted to move from a first curing position to a second curing position and is adapted to move from the second curing position to the first curing position. However for the curing stations, the system will not allow the operator to program a flash curing head to start at the rear (inner) position. Thus, for the curing heads/stations, the front/rear switches are adapted to place the curing apparatus only at the front position. A main shutoff valve is also provided to shut off the pressure to the heads after a short delay so that the heads can sequence to the preset position. Since the front/rear switches can only be set to have a curing station preset to a front position, there is provided in the present invention a curing safety system for preventing curing heads from ending up in the rear position upon shutdown or an emergency condition. Again, the first and second positions can be adjusted for curing stations as well.

It is a further object of the present invention to provide a sequencing system which includes head assemblies that are adapted to remain at an outer position when the station/head is not set up to operate as a printing station.

It is a further object of the present invention to provide a sequencing system wherein all of the stations are adapted to operate as curing stations. It is also an object of the present invention to provide an efficient, cost-effective method of short, multi-color production runs. It reduces the number of operators necessary to perform the printing process, and the training and setup time for such process.

The present invention eliminates the need for multiple manual presses to perform short runs and frees up valuable floor space for other production. It is a still further object of the present invention to eliminate the need for a station to cool down the ink and the article to be printed after curing.

Other advantages and aspects of the invention will become apparent upon making reference to the specification, claims and drawings to follow.

BRIEF DESCRIPTION OF DRAWINGS

FIG. 10 is the tenth part of a flow chart for one embodiment of a previous program that controlled the process controller printing functions and operator entry for a previous printing press.

FIG. 14 is the fourteenth part of a flow chart for one embodiment of a previous program that controlled the process controller printing functions and operator entry for a previous printing press.

FIG. 31 is the seventh part of a sub-portion of a flow chart for one embodiment of the program that controls the process controller printing functions and operator entry for the same.

FIG. 33 is the ninth part of a sub-portion of a flow chart for one embodiment of the program that controls the process controller printing functions and operator entry for the same.

FIG. 34 is the tenth part of a sub-portion of a flow chart for one embodiment of the program that controls the process controller printing functions and operator entry for the same.

DETAILED DESCRIPTION OF THE INVENTION

Figure 1:
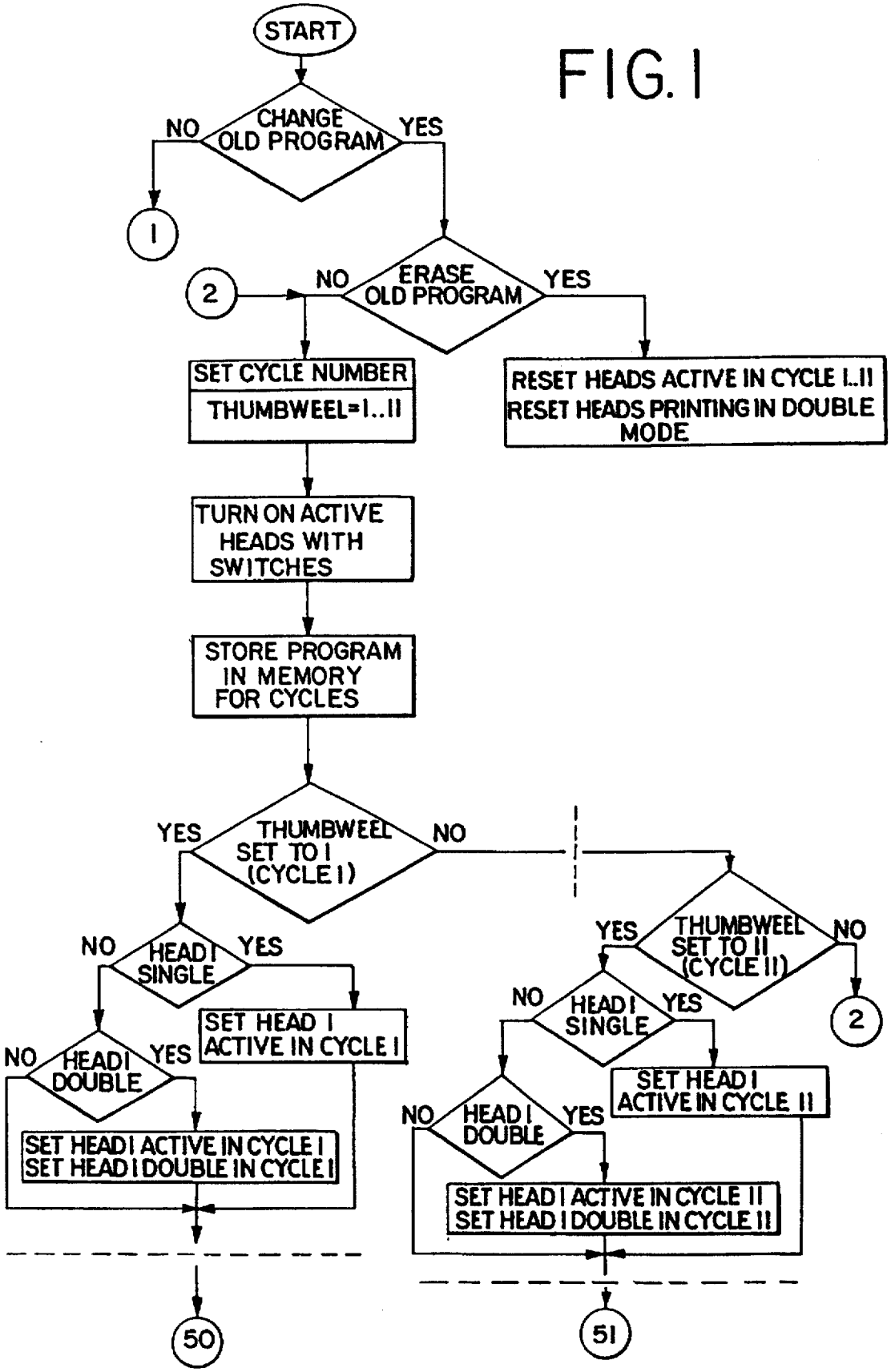
FIG. 1 is the first part of a flow chart for one embodiment of a previous program that controlled the process controller printing functions and operator entry for a previous printing press.
Figure 2:
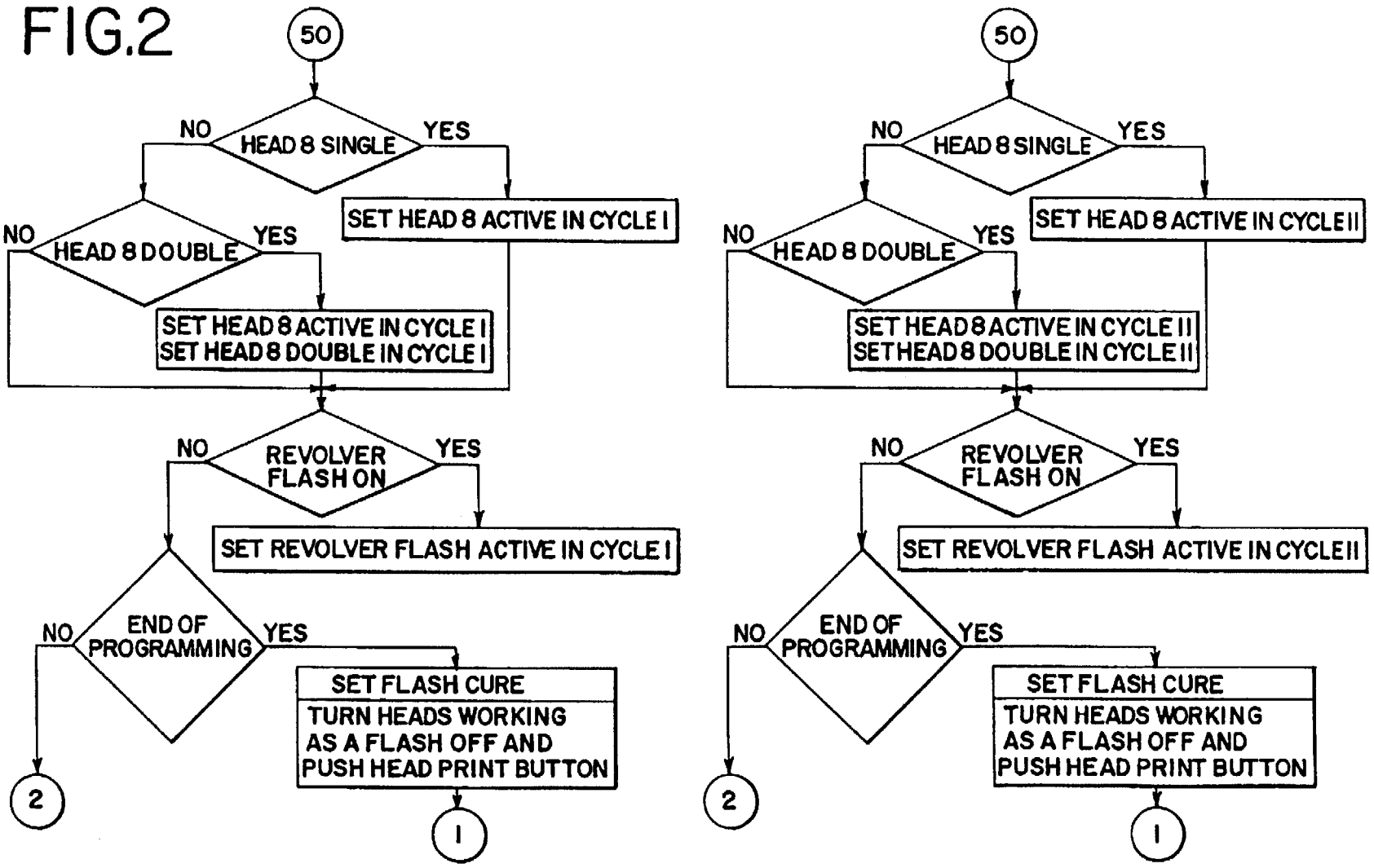
FIG. 2 is the second part of a flow chart for one embodiment of a previous program that controlled the process controller printing functions and operator entry for a previous printing press.
Figure 3:
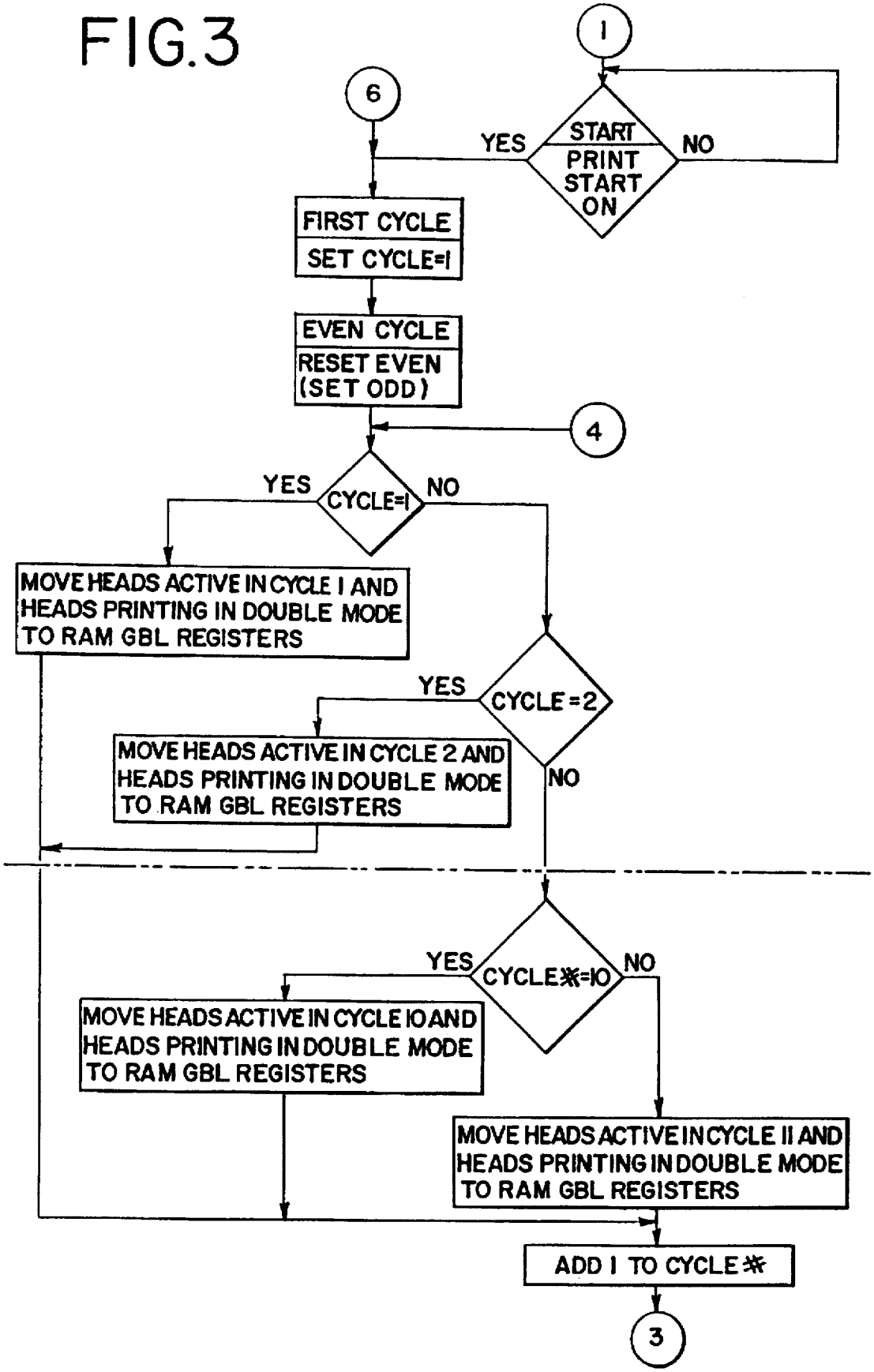
FIG. 3 is the third part of a flow chart for one embodiment of a previous program that controlled the process controller printing functions and operator entry for a previous printing press.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 16:
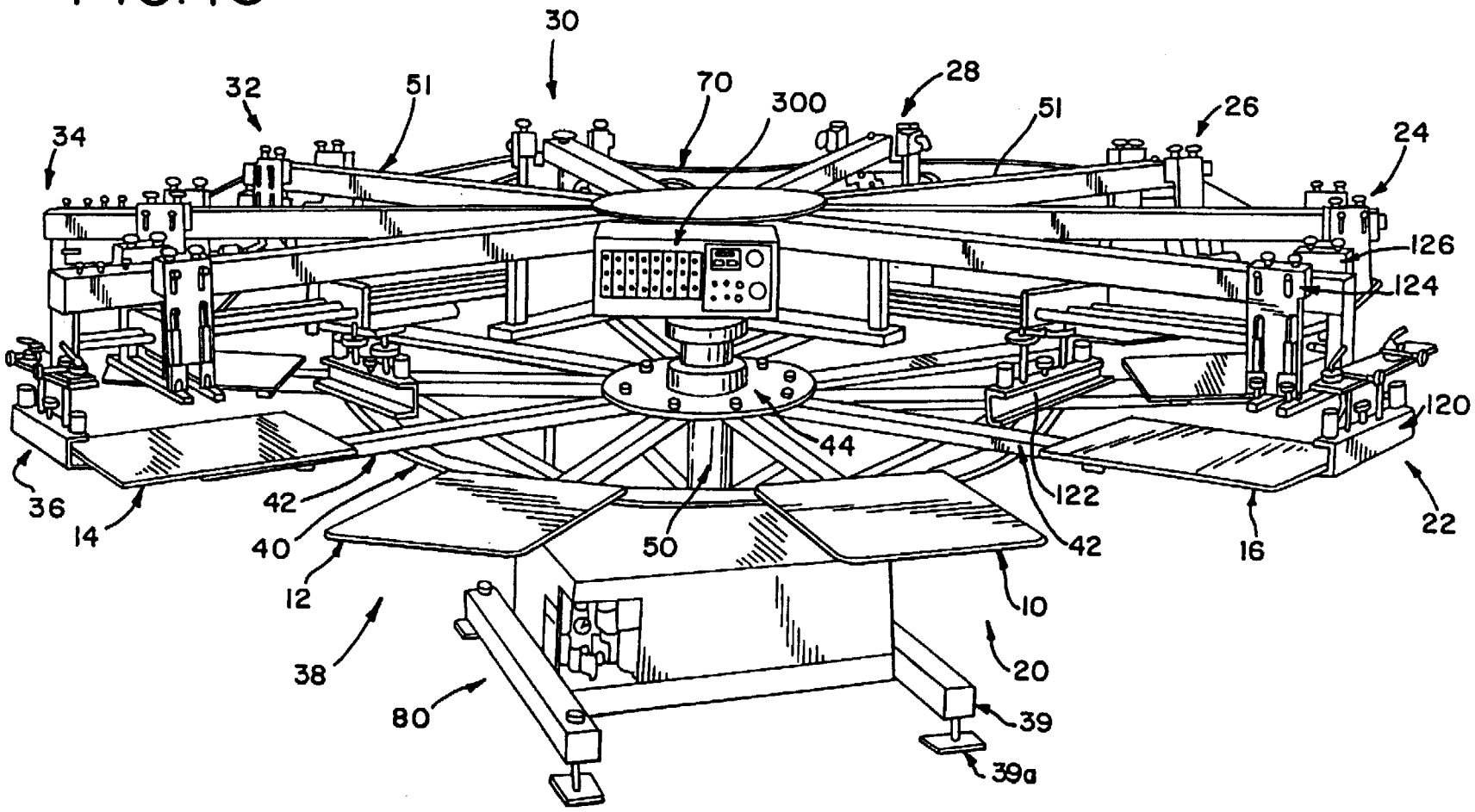
FIG. 16 is a perspective view of one embodiment of the printing press of the present invention.

Referring to FIG. 16, one embodiment of the printing press apparatus of the present invention is shown. For the purposes of the embodiment that will be described below, the beds will rotate in a counter-clockwise manner, while it being understood that rotation can take place in the opposite direction as well. The printing press of FIG. 16 includes ten separate stations. It will be understood that the printing press can have less or more than ten stations. A loading/unloading station 20 is the station at which the article of clothing (not shown), or item (not shown) being printed upon, is placed for printing. A user or automatic feeder will place the item on the bed that is positioned at station 20. FIG. 16 depicts bed 10 being positioned at station 20 for loading or unloading of the item. The press in FIG. 16 also includes a station one 22 at which the first ink color can be smeared or printed upon the item. Station two 24, station three 26, station four 28, station five 30, station six 32, station seven 34, and station eight 36 are provided for printing ink upon the items as well as for alternatively curing the ink which is printed upon the items at previous stations. Unloading/curing station 38 is also provided for unloading the items from the beds when the printing is completed or alternatively for curing the items through the use of a separate curing apparatus. When station 38 is set up as a curing station, the curing apparatus is placed over the bed that is present at station 38 and is connected to a control panel 300 for proper sequencing of the printing process.

The press of FIG. 16 further includes a base 39 from which the rest of the printing press apparatus is supported. The base includes four adjustable supports 39*a* which can be used to level the orientation of the press (i.e.—for a working space with an uneven floor). A main shaft 50 extends upwardly from and is fixedly attached to the base 39. Station arms 51 extend outwardly from and are fixedly attached to the shaft 50. The shaft 50 supports the station arms 51 through a structural support apparatus that attaches the station arms 51 to the shaft 50 such that the structural support apparatus can withstand the forces created by the weight and movement along the length of each of the station arms 51.

Figure 20:
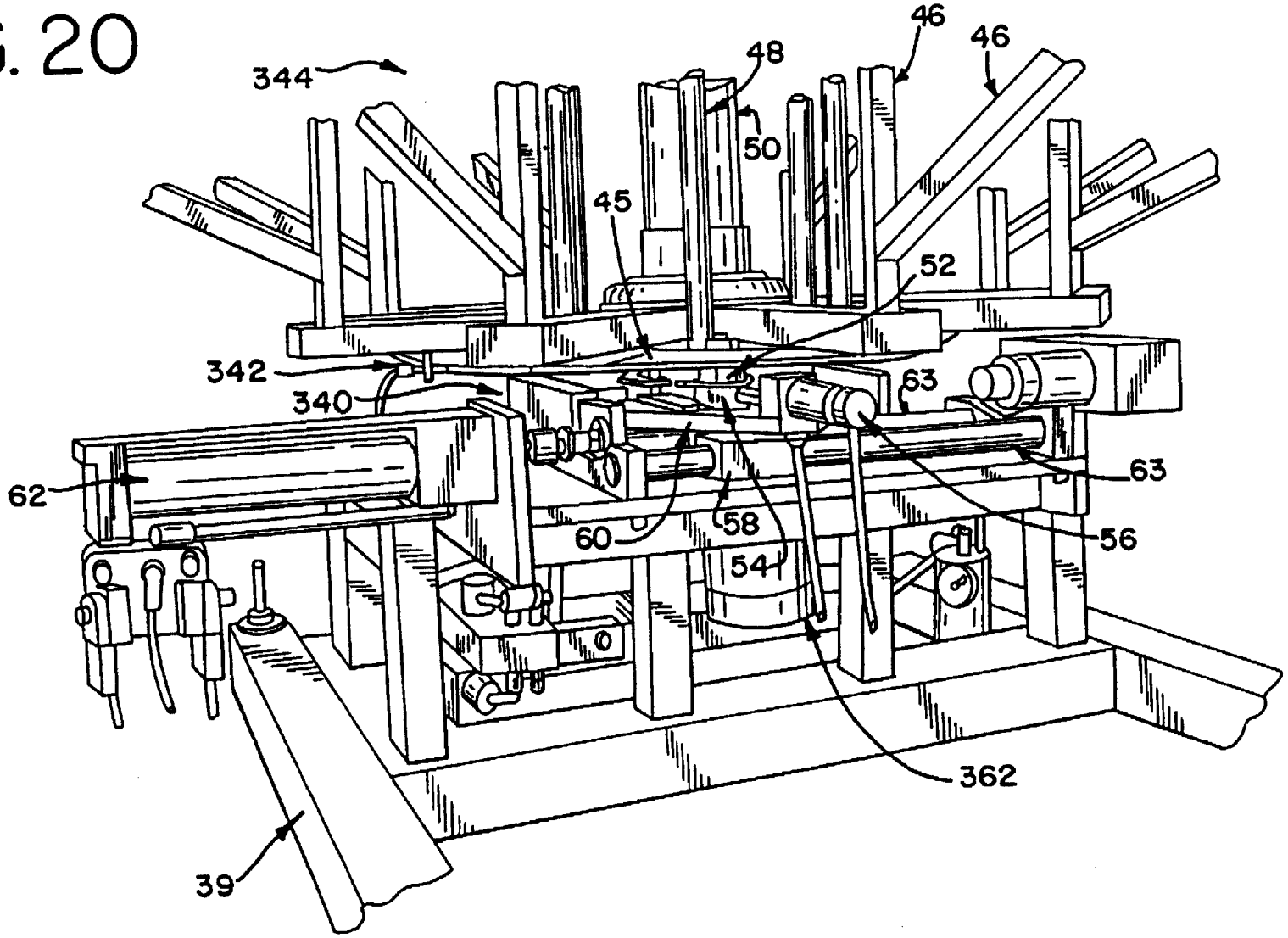
FIG. 20 is a partial view of the printing press of FIG. 16 and a perspective view of the indexing apparatus of the printing press of the present invention.

The embodiment in FIG. 16 also includes bed arms 42 for each of the beds 10, 12, 14, 16 as well as bed arms for the other four beds (not numbered). The bed arms 42 are fixedly attached to and support each of the beds. The bed arms 42 are structurally joined together at an upper bed arm hub 44. The upper bed arm hub 44 has a bore through its center through which the main shaft 50 extends such that the hub 44 can axially and vertically slide up and down, and can also horizontally rotate around the main shaft 50. A bed wheel 40 is positioned substantially midway between the hub 44 and the beds with its center of rotation substantially aligned with the center of rotation of the hub 44. The bed wheel 40 is fixedly attached to each of the bed arms 42 for supporting the bed arms 42 and beds attached thereto. FIG. 20 depicts a more detailed view of the bed wheel 40, bed arms 42, and the remaining support structure for the beds as will be described in greater detail below.

Disposed on the base 39 of the press in FIG. 16 is a pressure gauge and valve assembly 80 which generally is used for controlling the air pressures being supplied to the valves and cylinders within the press. One main connection port is provided for attachment to an external pressure supply. In addition, a plurality of electrical pressure switch valves are disposed on the base 39 to provide and take away pressure to and from the several cylinders within the press.

Returning to the several stations within the embodiment of FIG. 1, an emergency/safety cable 70 extends along the periphery of the press between station one 22 and station eight 36. Disconnection plugs exist along the length of the cable 70 between each station from station one 22 to station eight 36. If an operator wishes to shut down the press while it is in operation, the user need only disconnect the female and male portions of the plug between two of the stations instead of returning to the operator control panel 300 to do the same. Alternatively, an operator that is working between two stations, for setup purposes or for maintenance purposes, needs to break or unplug the male and female plug connection at that location between the two stations in order for the operator to physically enter the area between the two stations. Thus, the cable serves as a means to prevent the press from starting up while the press is being setup or being maintained while keeping in mind that the beds rotating can create a substantial injury hazard.

Substantially at one end (the outer end or the end opposite the end of axial rotation of the beds) of each of the station arms 51 is an apparatus that can be configured to print the ink onto the items or alternatively to cure the ink that was already printed on an article or item. FIG. 16 shows the press neither specifically configured for printing nor for curing of the ink. However, FIG. 16 does show that each station arm 51 integrally supports a left head portion 124 and a right head portion 126. In addition, each station head integrally supports an outer clamp 120 and an inner clamp 122. The structure integral with each of the station arms 51 will be described in more detail within FIGS. 17 and 18 below.

Figure 17:
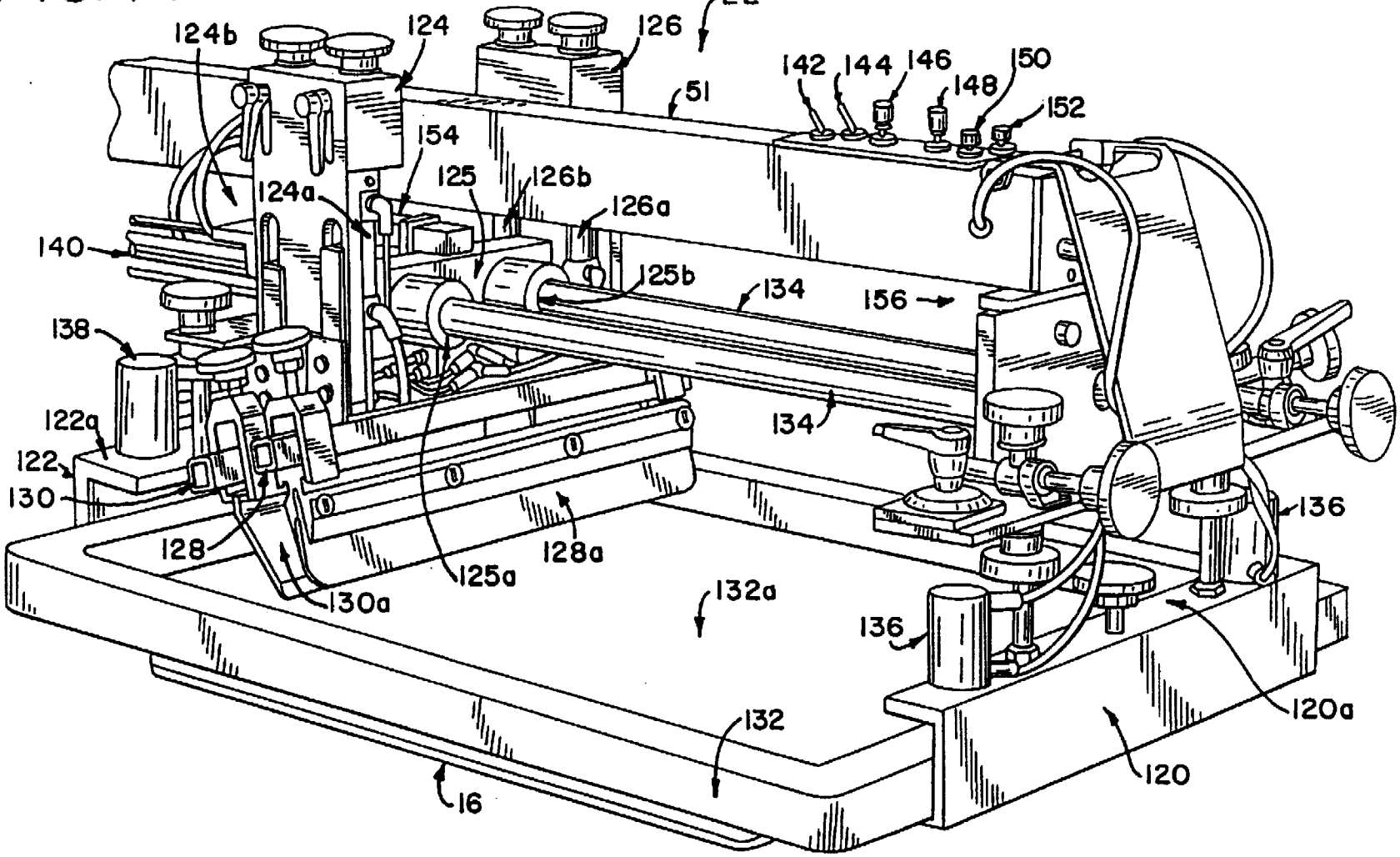
FIG. 17 is a perspective view of one embodiment of a station set up as a printing station in the printing press of the present invention.

FIG. 17 discloses one of the stations one 22 through eight 36 configured to work as a printing station. As noted above this printing station includes an outer clamp 120 that is fixedly and adjustably attached to the station arm 51 via a first adjustment assembly. The printing station of FIG. 17 also includes an inner clamp 122 that is fixedly and adjustably attached to the station arm 51 via a second adjustment assembly. The outer clamp 120 has two outer screen lock pressure cylinders 136 mounted such that cylinder rods (not shown) within the cylinders 136 protrude through the top face 120*a* of the outer clamp 120. The inner clamp 122 has two inner screen lock pressure cylinders 138 mounted such that cylinder rods (not shown) within the cylinders 138 protrude through the top face 122*a* of the inner clamp 122.

A silk screen assembly 132 is disposed between the outer and inner clamps 120, 122 respectively. A silk screen 132*a* is integrated into the silk screen assembly 132 and the whole assembly 132 can be adjusted between the two clamps 120, 122 in order to properly align the silk screen 132*a* on top of the bed 16. The alignment of the silk screen or pallet assembly 132 above the bed 16 can be performed using the device and method from U.S. Pat. No. 5,129,155 entitled "Automatic Screen Registration Device and Method Therefor," and assigned to M & R Printing Equipment, Inc., this patent disclosure being incorporated by reference herein and being made a part of the specification hereof. Furthermore, the silk screen assembly or pallet assembly 132 can be properly constructed and tensioned by a device and method such as the one described in U.S. Pat. No. 5,063,842 (Clarke), entitled "Screen Tensioning and Framing Device and Method Therefore", and assigned to M & R Printing Equipment, Inc., this patent disclosure being incorporated by reference herein and being made a part of the specification hereof.

When the silk screen assembly 132 is properly aligned, both the outer and inner screen lock pressure cylinders are engaged or locked onto the silk screen assembly 132 to keep the assembly 132 in a stationary position. Aligning the silk screen 132*a* and locking the assembly into the correct stationary position is important because the alignment must match up with the alignment of the silk screens 132*a* at the other printing stations in order to obtain a quality ink design on the item. For ease of setup, there is provided a first screen lock cylinder pressure switch 142 and a second screen lock cylinder pressure switch 144. The first switch 142 locks and unlocks the outer cylinders 136, and the second switch 144 locks and unlocks the inner cylinders 138. As soon as the operator properly aligns the screen assembly 132, she can then lock the assembly into the proper stationary position with these first and second switches 142, 144.

FIG. 17 additionally depicts the bed or pallet 16 in its up position such that the item or article (not shown) is sandwiched between the pallet 16 and the silk screen assembly 132 for printing of the ink onto the item. The actual printing at each printing station is performed by a head apparatus that slides back and forth on two head shafts 134. The head apparatus comprises a center head portion 125 that includes a first head bore 125*a* and a second head bore 125*b* through which the two head shafts 134 protrude. The center head portion 125 slides back and forth on the head shafts 134 with the force of a head position pressure cylinder 140 as will be described in greater detail below.

At one end of the center head portion 125, a left head portion 124 is fixedly attached to the center head portion 125 such that the left head portion 124 moves in unison with the center head portion 125. At the other end of the center head portion 125, a right head portion 126 is also fixedly attached to the center head portion 125 such that the right head portion 126 moves in unison with the center head portion 125 as well. Each of the left and right head portions 124, 126 have adjustably mounted thereon a squeegee bar pressure cylinder 124*a*, 126*a* and a flood bar pressure cylinder 124*b*, 126*b*. The squeegee bar pressure cylinders 124*a*, 126*a* are both also fixedly attached to a squeegee bar 128. A squeegee 128*a* is adjustably mounted to the squeegee bar 128. In addition, the flood bar pressure cylinders 124*b*, 126*b* are both also fixedly attached to a flood bar 130, and a flooder 130*a* is adjustably mounted to the flood bar 130. The flooder 130*a* is used to flood the interior of the screen assembly 132 with ink where the design interstices are located. The flooding is performed by first lowering the flooder 130*a* until it is very close to or until it contacts the silk screen as can be adjusted by one of ordinary skill in the art. The lowering of the flood bar 130 and flooder 130*a* is performed though the flood bar cylinders 124*b*, 126*b* being pressurized by the opening of pressure valves connected thereto. Thus, the cylinders 124*b*, 126*b* are extended to perform the lowering of the flooder 130*a*. Once the flooder 130*a* is lowered, the flooding continues through moving the flooder 130*a* across the face of the silk screen 132*a* which in turn smears the ink over the area where the design interstices exist on the silk screen 132*a*. The flooder 130*a* and flood bar 130 are then raised by the flood bar cylinders 124*b*, 126*b* from which air is removed for retraction of the cylinders 124*b*, 126*b*. The Squeegee 128*a* is then used to squeegee the ink that is smeared across the face of the screen 132*a* through the interstices that are located within interior of the screen assembly 132. The squeegeeing is performed by first lowering the squeegee 128*a* until it is very close to or until it contacts the silk screen as can be adjusted by one of ordinary skill in the art. The lowering of the squeegee bar 128 and squeegee 128*a* is performed though the squeegee bar cylinders 124*a*, 126*a* being pressurized by the opening of pressure valves connected thereto. Thus, the cylinders 124*a*, 126*a* are extended to perform the lowering of the squeegee 128*a*. Once the flooder 130*a* is lowered, the flooding continues through moving the squeegee 128*a* across the face of the silk screen 132*a* which in turn forces ink through the interstices where the design exists on the silk screen 132*a*. The squeegee 128*a* and squeegee bar 128 are then raised by the squeegee bar cylinders 124*a*, 126*a* from which air is removed for retraction of the cylinders 124*a*, 126*a*. This sequence is called a single stroke printing or single printing. For designs that require enhanced inking or a thicker layer of ink on the item, double stroke printing or double printing can be performed. Double printing repeats the sequence of single printing twice.

Within single and double printing, the head assembly (including the several head portions 124, 125, 126 and elements connected thereto) slides or moves back and forth along the two head shafts 134. The sliding takes place through the extension and retraction of a head position pressure cylinder 140 that is fixedly attached to the center head portion 125. Cylinder 134 is integrally connected to two control valves 146, 148. Valve 146 controls the rate at which air pressure enters cylinder 134, and thus controls the rate at which the head assembly moves in one direction across the silk screen assembly 132 (or item when the station is set up for curing). Likewise, valve 148 controls the rate at which air pressure releases or exits from cylinder 134, and thus controls the rate at which the head assembly moves in the opposite direction across the silk screen assembly 132 (or item when the station is set up for curing). Flood control stroke push button 150 and squeegee control stroke push button 152 are provided for manually testing and stroking the flooder 130*a* and squeegee 128*a*, respectively. These push buttons 150,152 provide an operator with a convenient way to test and setup the heads or stations as print stations.

The printing head apparatus of FIG. 17 also includes a rear proximity switch or detector 154 and a front proximity switch 156 for determining or detecting when the head portion or assembly is in the rear (inner) or front (outer) positions, respectively. The head position pressure cylinder 140 controls the strokes of the head portion during the flooding stroke and the squeegee stroke. Station arm 51 is provided for supporting all of the previous apparatus within FIG. 17 as well as several adjustment and locking knobs. The adjustment knobs can be used to adjust the length of the strokes (position of the inner and outer clamps 120, 122) as well as to change out a print head and turn it into a curing head, among other adjustments. One additional detector, a no shirt detector (not shown), is mounted to each of the head portions or stations for determining if a shirt is on the pallet or bed underneath the station. The no shirt detector is preferably an infrared beam type detector which uses a retro-reflective photoelectric eye and a highly reflective surface to detect the presence or non-presence of a shirt or item on the bed (pallet).

Figure 18:
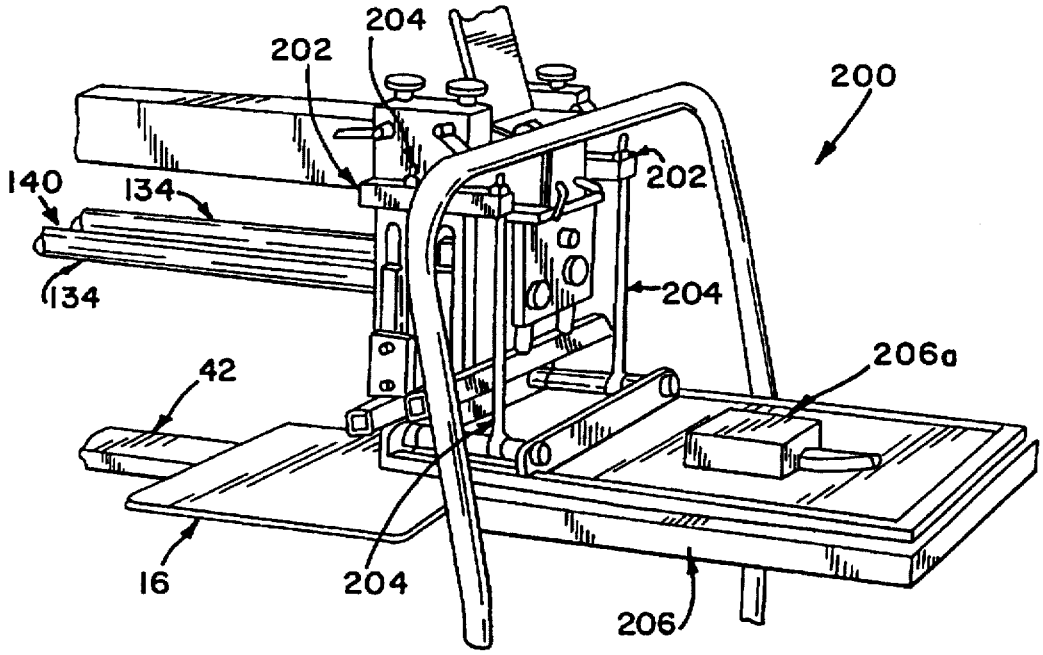
FIG. 18 is a perspective view of one embodiment of a station set up as a curing station in the printing press of the present invention.
Figure 19:
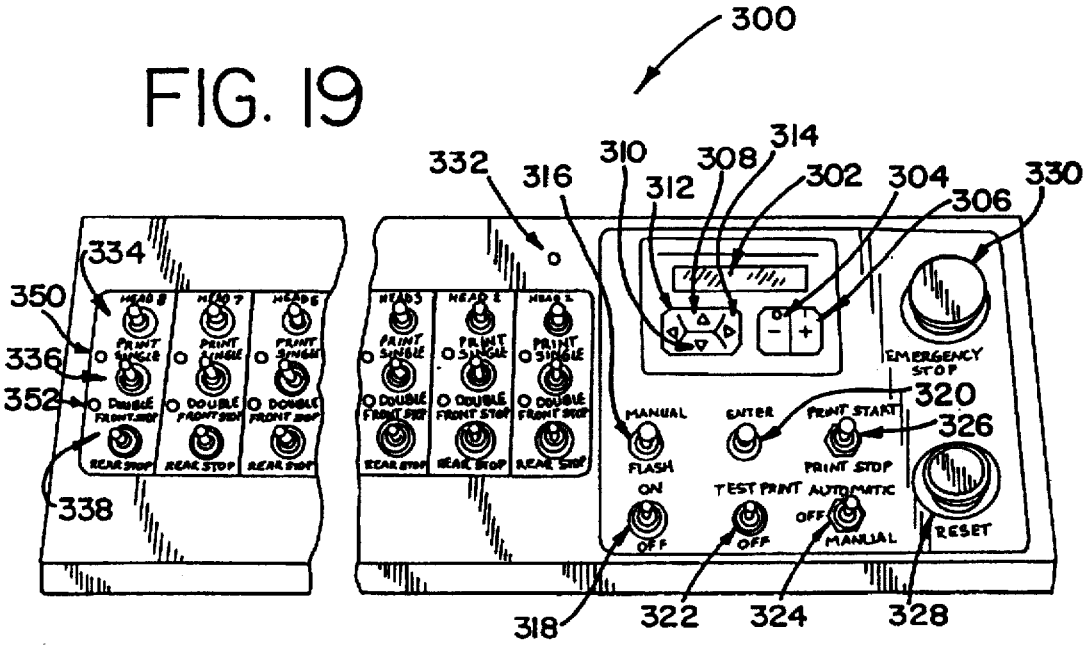
FIG. 19 is a front view of one embodiment of the operator panel or control panel of the printing press of the present invention.

FIG. 18 discloses a curing attachment assembly 200 of the present invention which can be attached to a station within the printing press. For such a curing assembly 200, attachment bars 202 are adjustably mounted to the left and right head portions 124, 126 of the head assembly. Attachment rods 204 are adjustably mounted to the attachment bars 202. The attachment rods 204 extend downwardly from the attachment bars 202. A curing/ radiation panel 206 is adjustably mounted to the attachment rods 204 beneath the head portion. A power connection 206*a* is disposed on top of the curing panel 206 for providing power to the curing panel 206. FIG. 18 also depicts the pallet or bed 16, bed arm 42, head shafts 134, and head position pressure cylinder 140 (behind the head shaft 134) for relation between the drawings herein.

Figure 4:
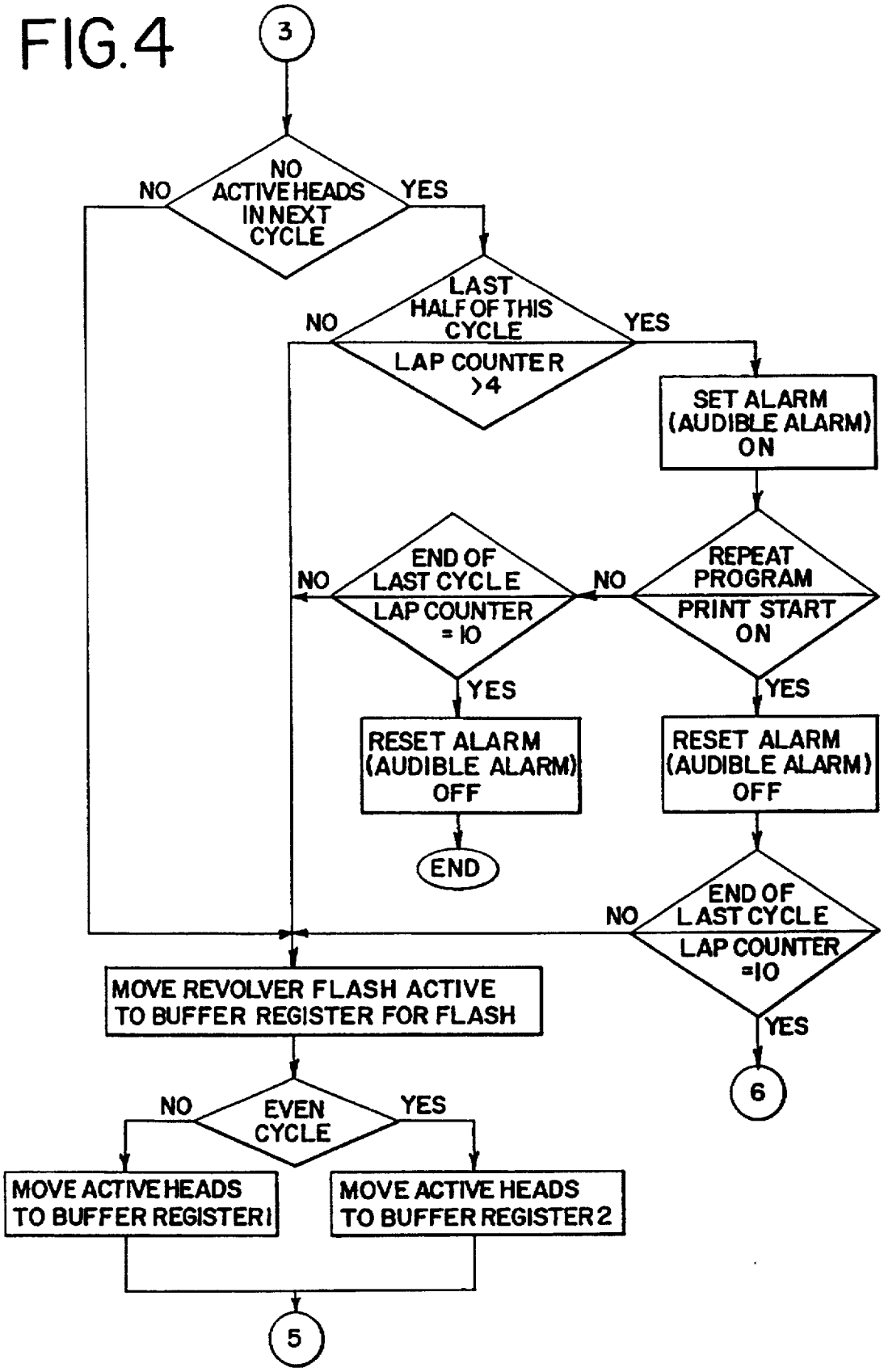
FIG. 4 is the fourth part of a flow chart for one embodiment of a previous program that controlled the process controller printing functions and operator entry for a previous printing press.
Figure 5:
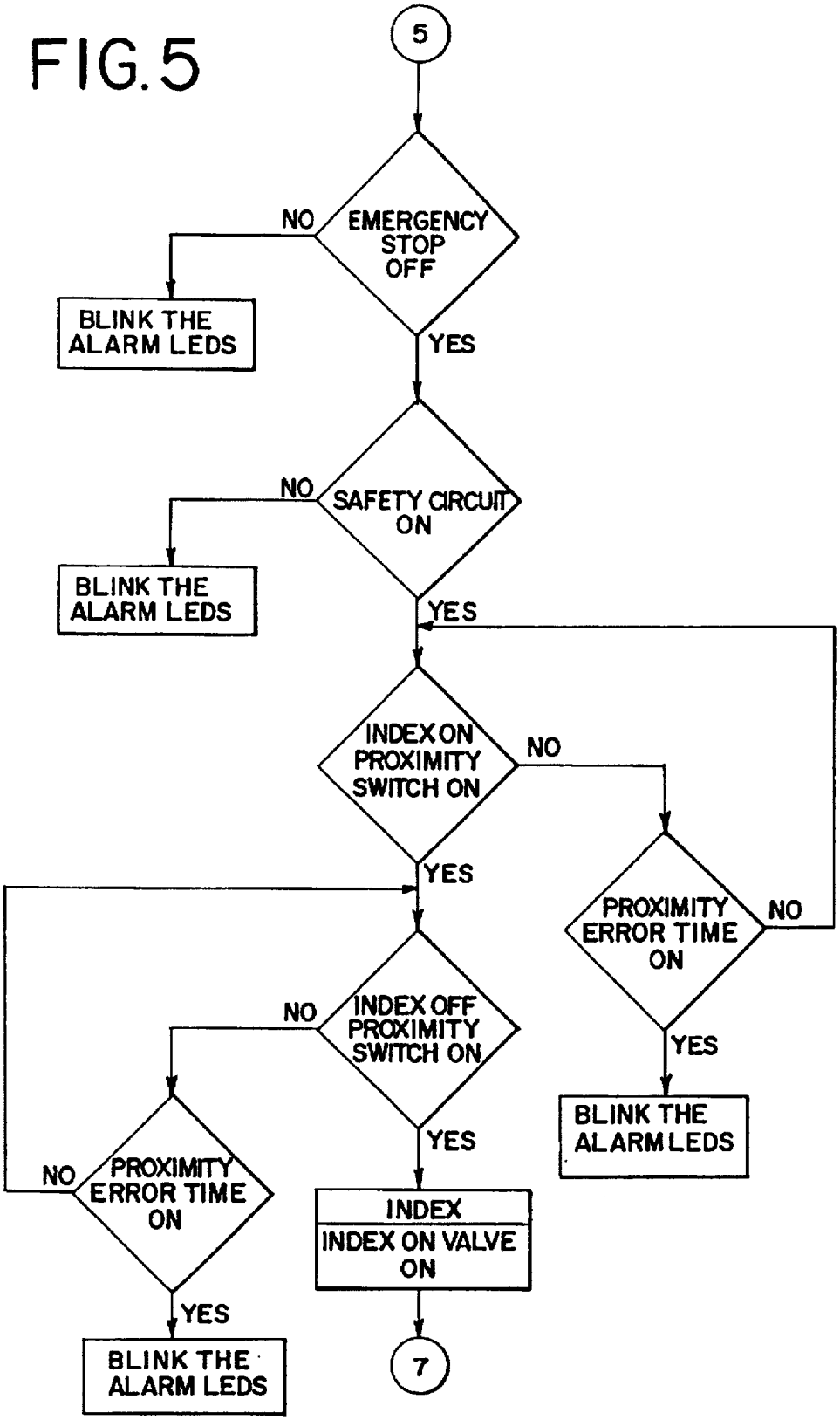
FIG. 5 is the fifth part of a flow chart for one embodiment of a previous program that controlled the process controller printing functions and operator entry for a previous printing.
Figure 6:
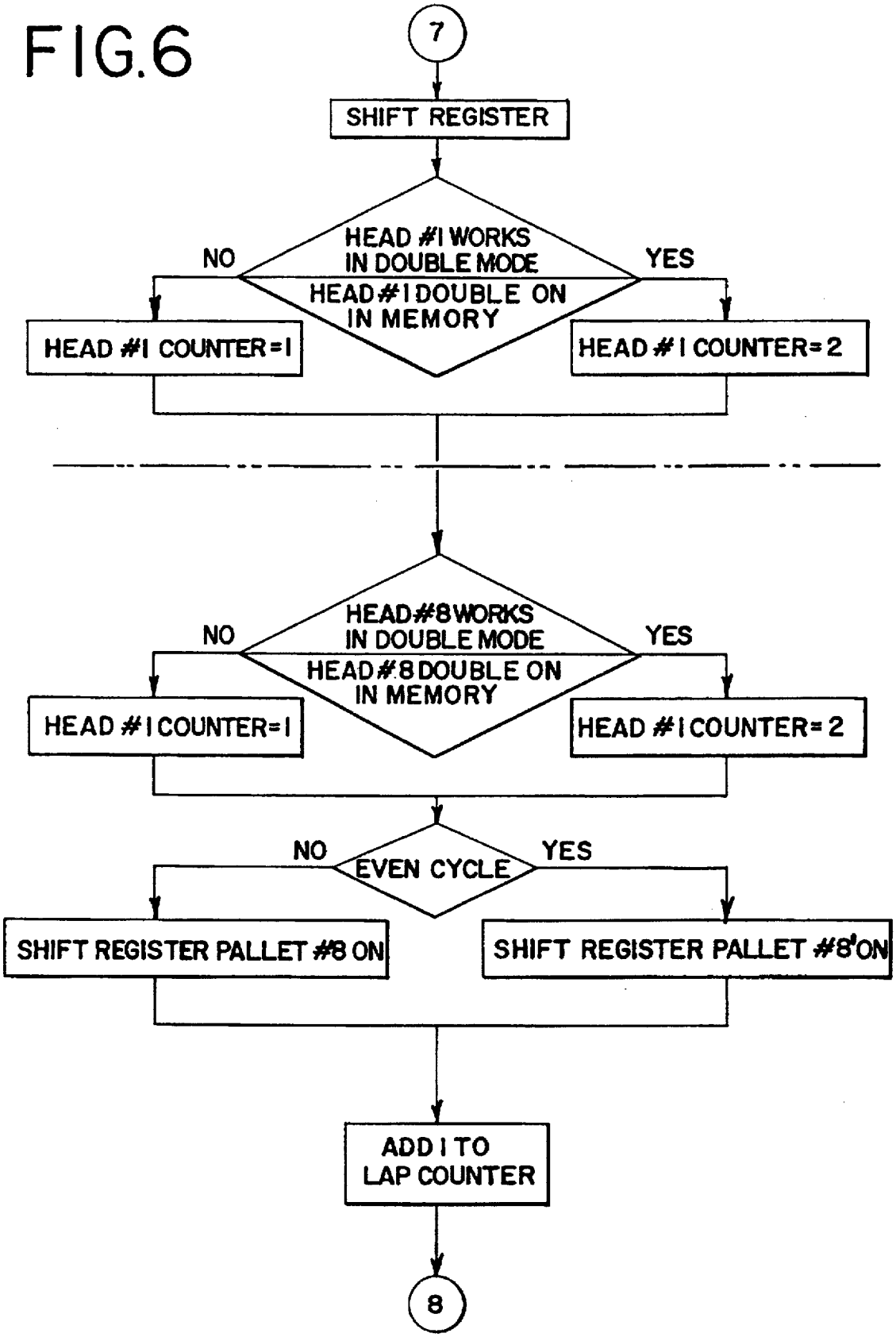
FIG. 6 is the sixth part of a flow chart for one embodiment of a previous program that controlled the process controller printing functions and operator entry for a previous printing press.
Figure 7:
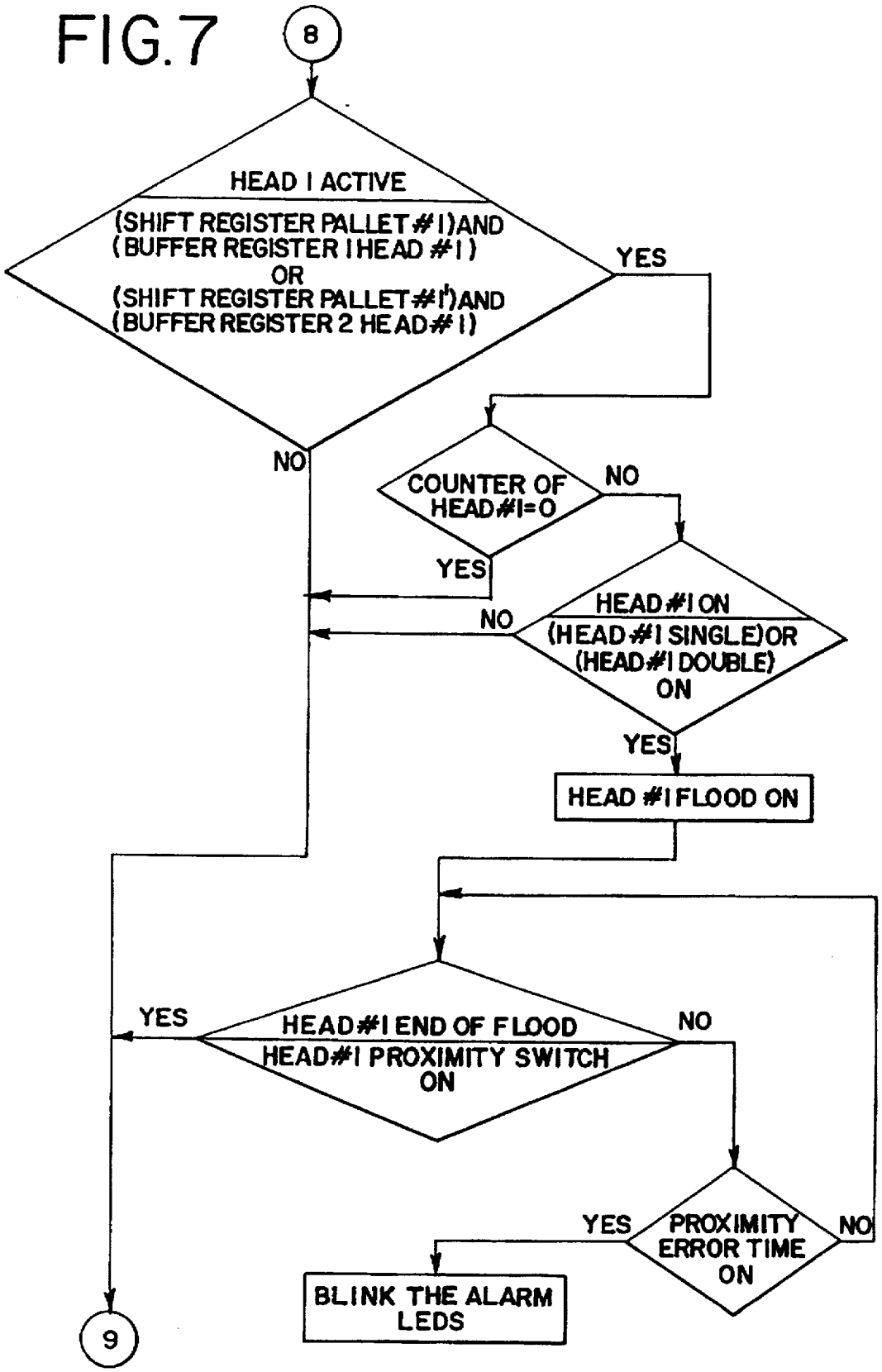
FIG. 7 is the seventh part of a flow chart for one embodiment of a previous program that controlled the process controller printing functions and operator entry for a previous printing press.
Figure 8:
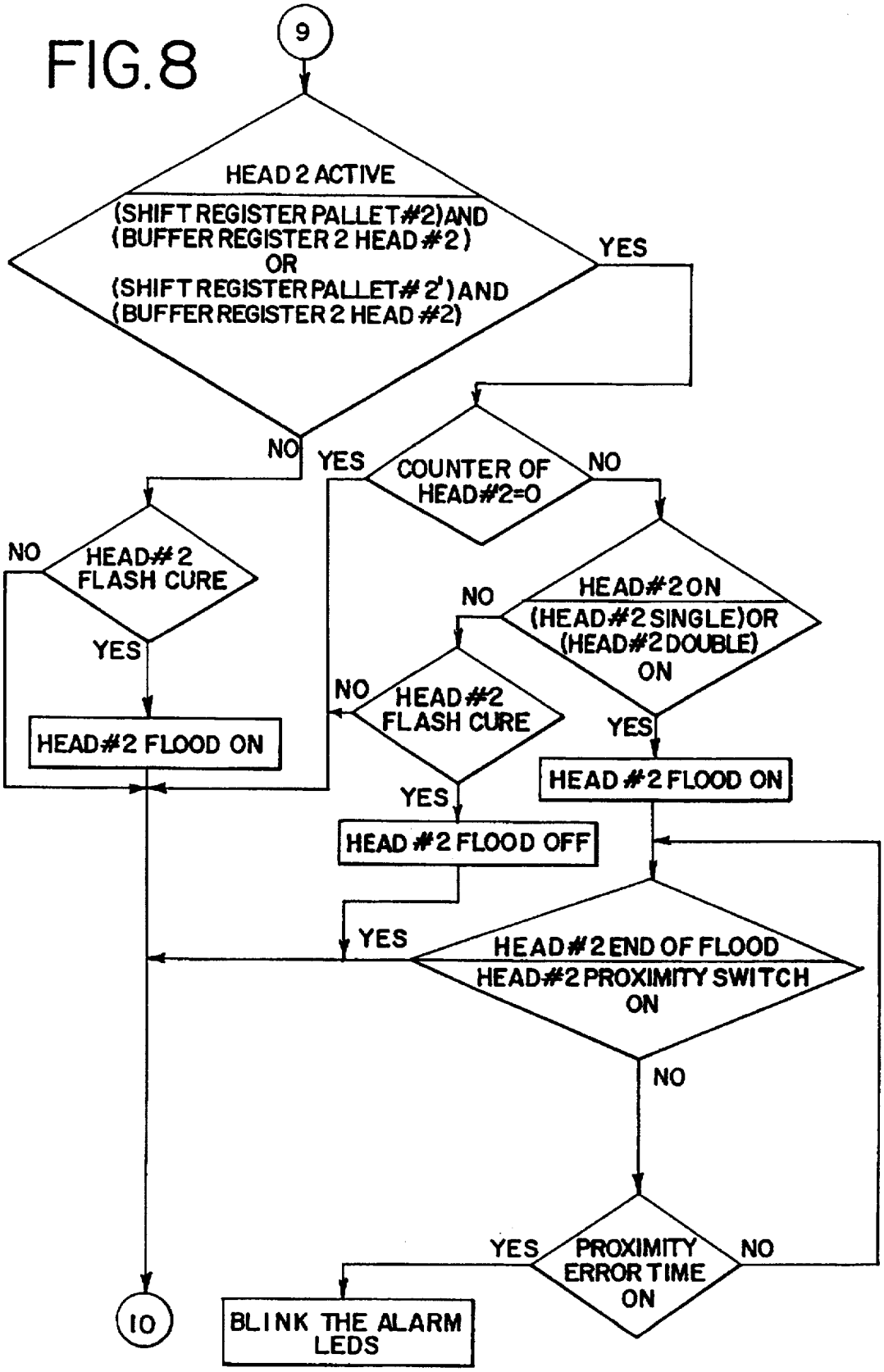
FIG. 8 is the eighth part of a flow chart for one embodiment of a previous program that controlled the process controller printing functions and operator entry for a previous printing press.
Figure 9:
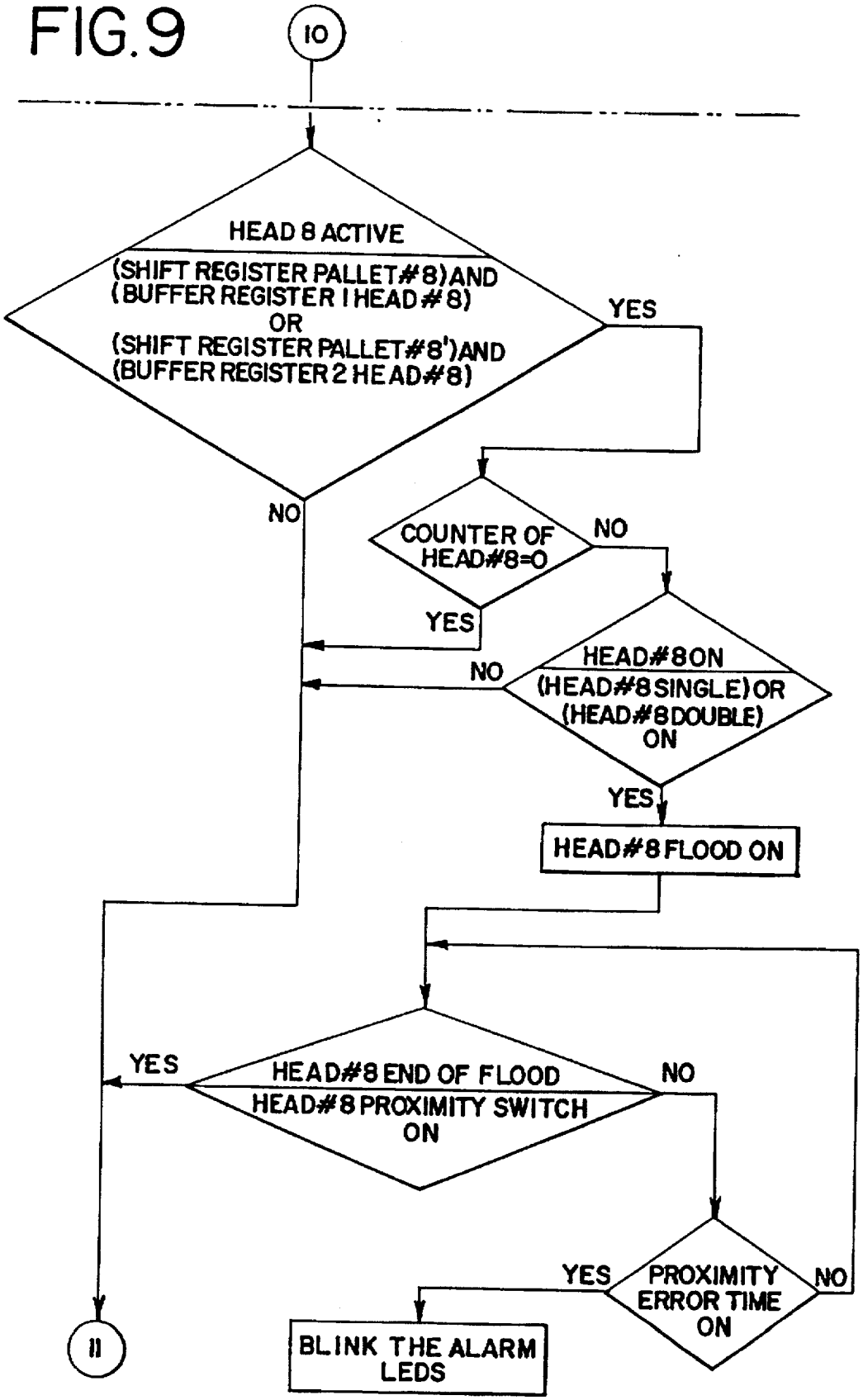
FIG. 9 is the ninth part of a flow chart for one embodiment of a previous program that controlled the process controller printing functions and operator entry for a previous printing press.
Figure 11:
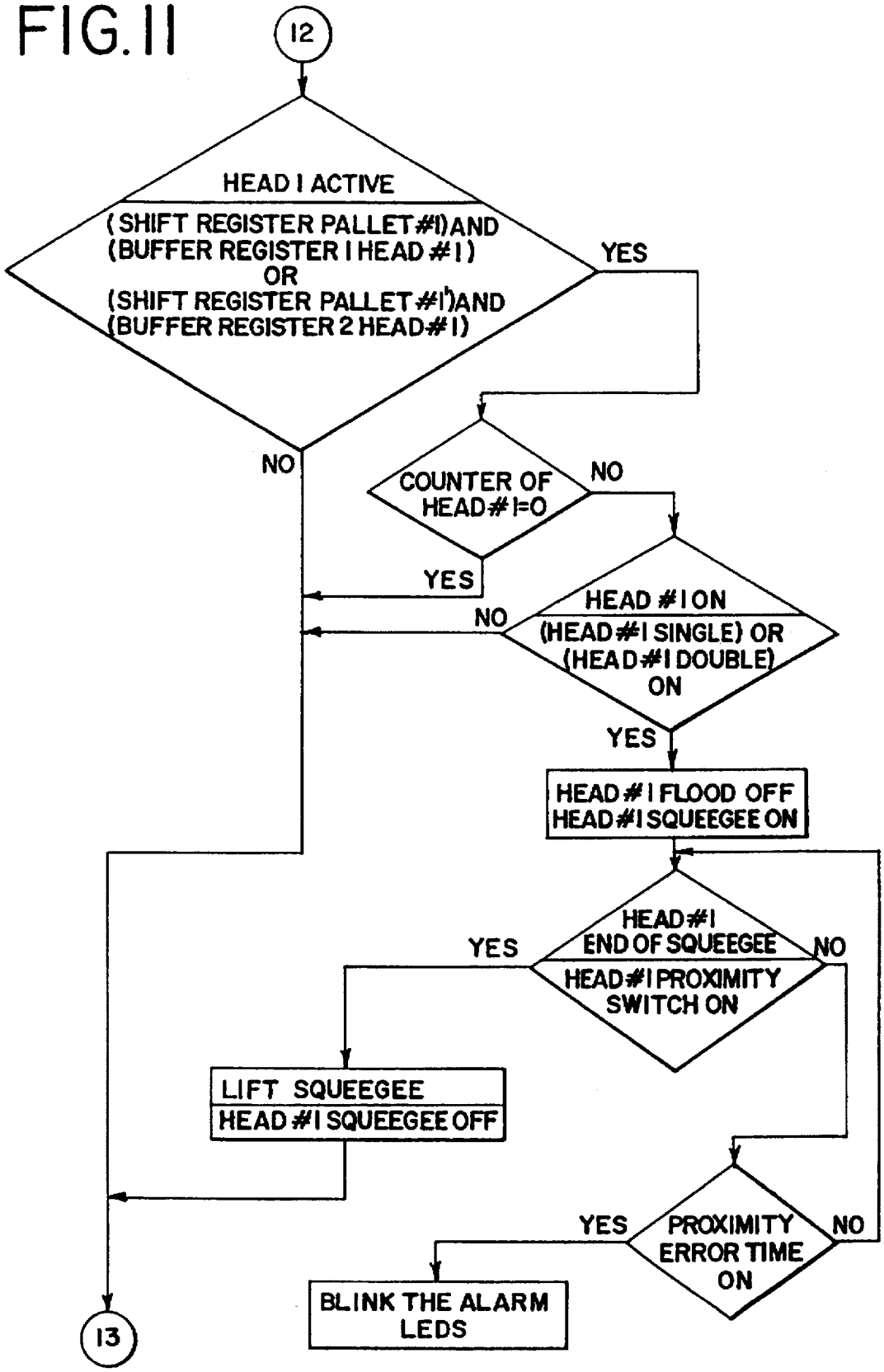
FIG. 11 is the eleventh part of a flow chart for one embodiment of a previous program that controlled the process controller printing functions and operator entry for a previous printing press.
Figure 12:
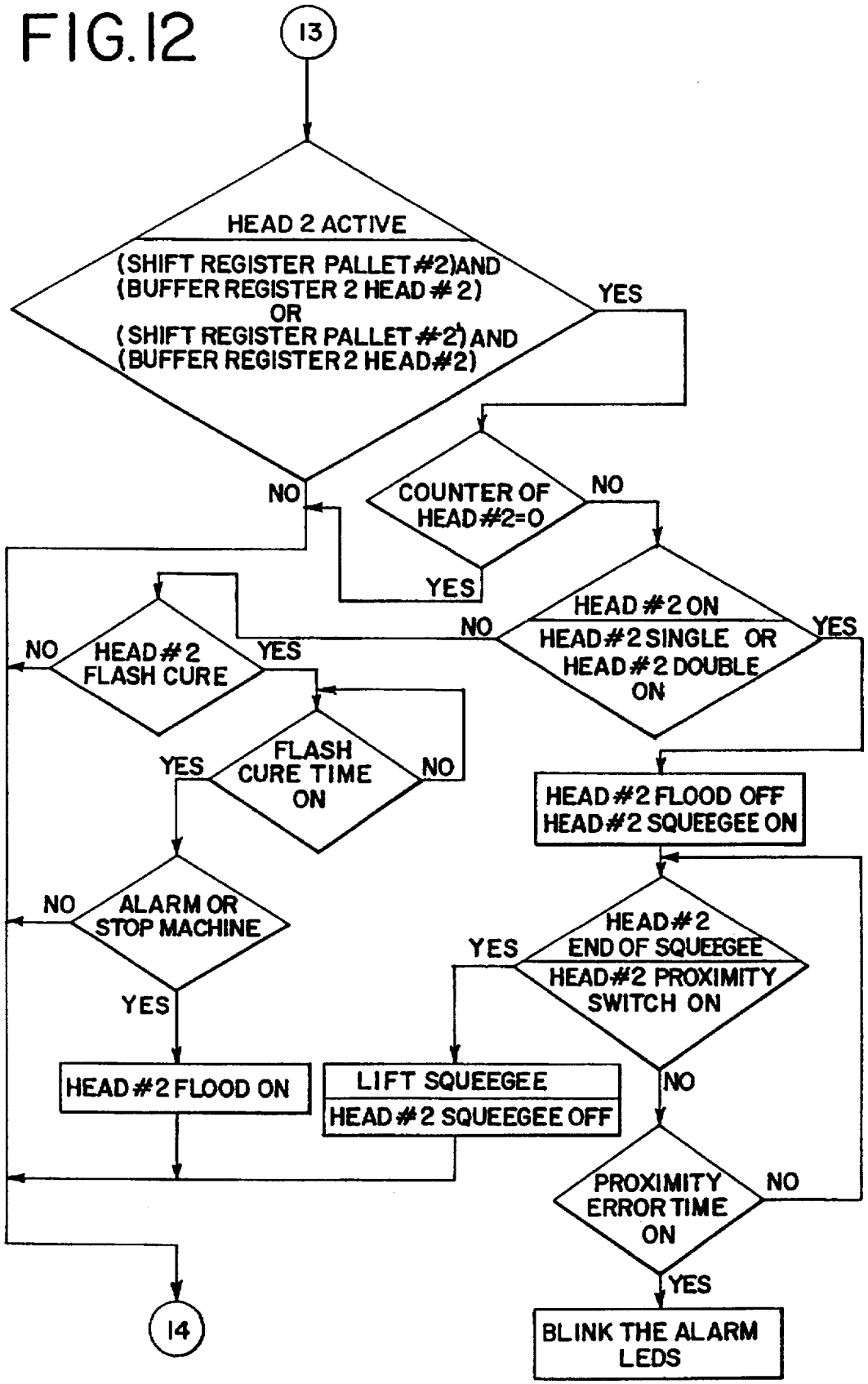
FIG. 12 is the twelfth part of a flow chart for one embodiment of a previous program that controlled the process controller printing functions and operator entry for a previous printing press.
Figure 13:
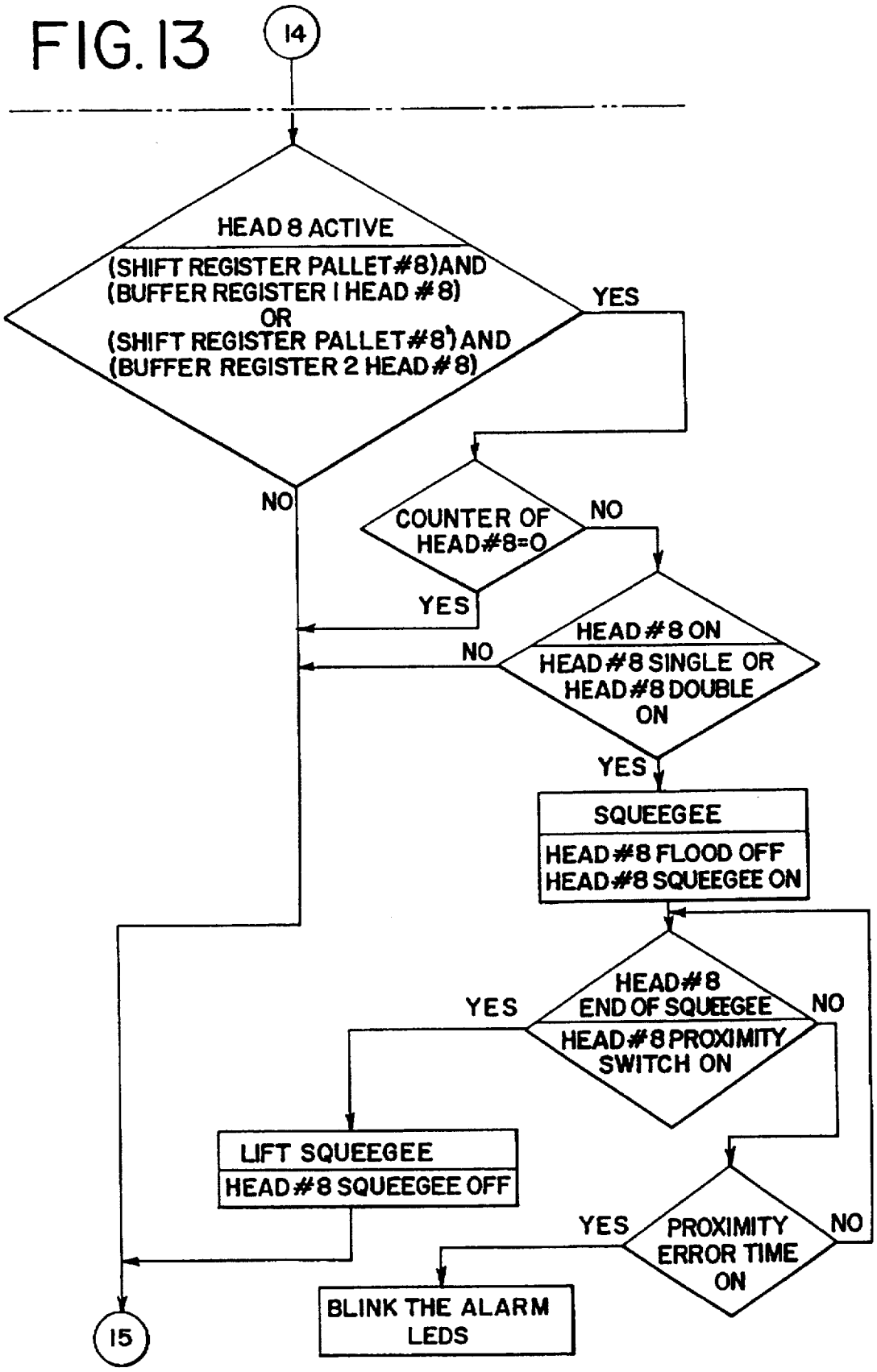
FIG. 13 is the thirteenth part of a flow chart for one embodiment of a previous program that controlled the process controller printing functions and operator entry for a previous printing press.
Figure 15:
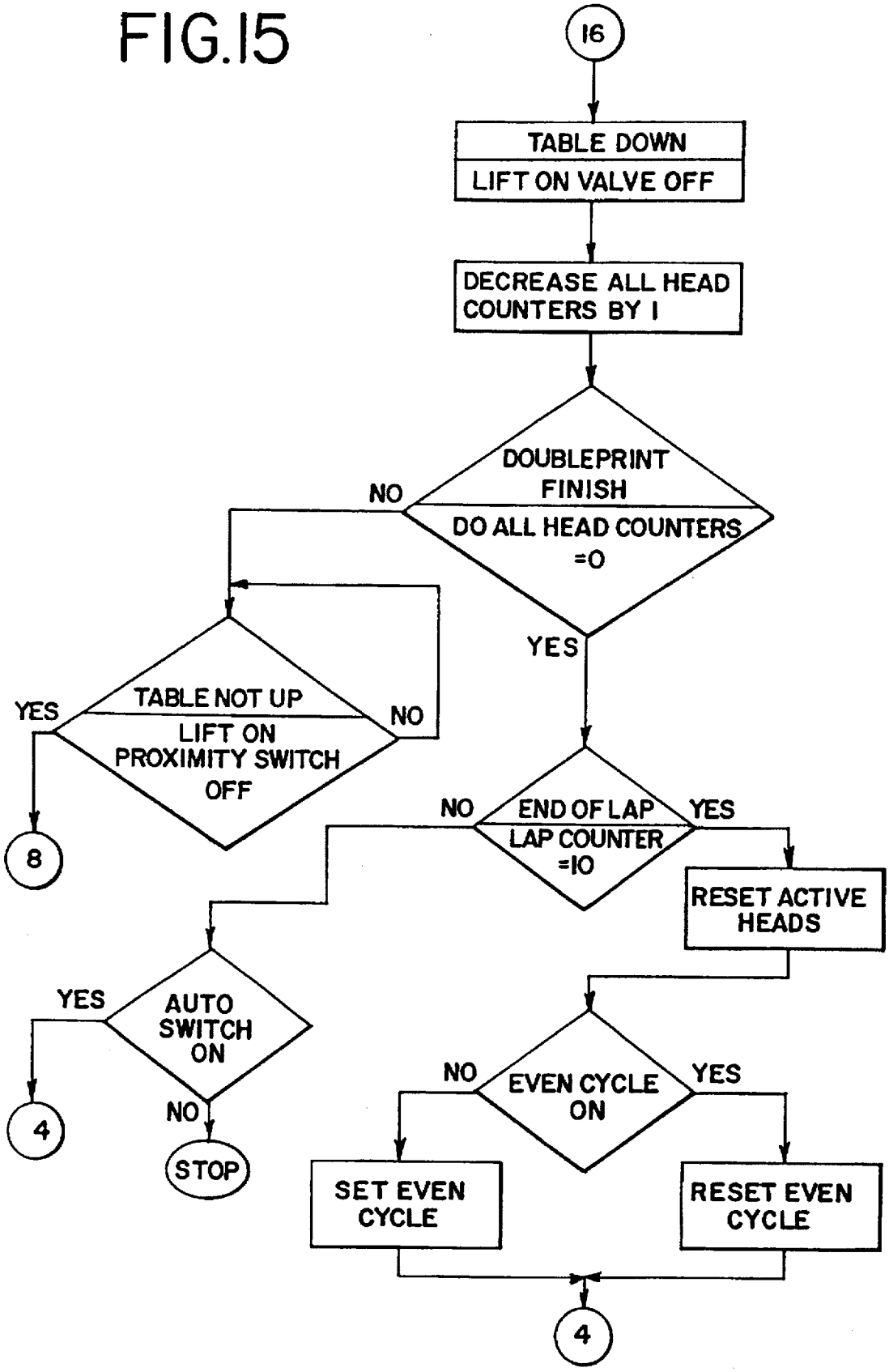
FIG. 15 is the fifteenth part of a flow chart for one embodiment of a previous program that controlled the process controller printing functions and operator entry for a previous printing press.
Figure 22:
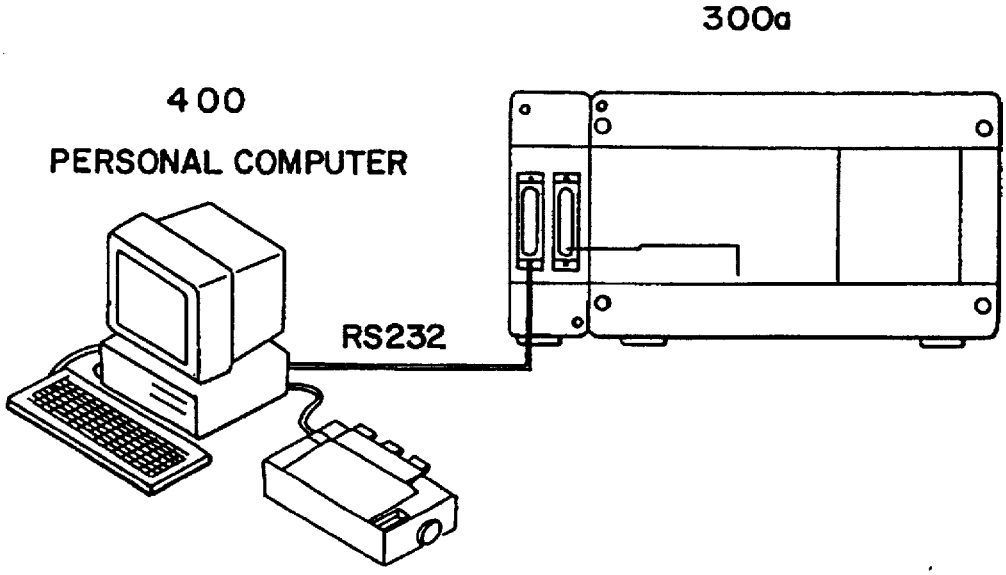
FIG. 22 is a diagram of the process controller within the control panel connected to a personal computer for communication between the same for control programming of the printing press of the present invention.

Referring to FIG. 4, an operator control panel 300 includes a controller 300*a* (not shown) (see FIG. 22). The control panel 300 has several functions which will be fully described below. However, there are several inputs and outputs on the face of the control panel 300 which interface the operator with the control program running on the controller 300*a*. These inputs and outputs include an LCD display 302 which allows the operator to easily interface with the controller 300*a*. The display 302 displays prompts during programming of the operator program information or job information which automatically sequences the printing press. In addition, the display 302 displays the status of each station at least during printing and during setup as well as other operator interface information. The plus button 306, minus button 304, up button 308, down button 310, left button 312, and right button 314 are all provided for entering information into the controller and for controlling the printing press. A manual/flash push button 316 exists for manually flashing the revolver curing station (station nine 38, FIG. 16). In addition, there is a flash on/off switch 318 for station nine 38 as well. If switch 318 is off, station 9 will not work as a curing station, and vice versa. Enter push button 320 is used for several operations as will be described below. One function of the enter button 320 is for entry of cycle and job information into the memory within the controller 300*a*.

Test print switch 322 allows the operator to test the stations before automated control is put into action. Auto/manual/off switch 324 is used for setting which mode the controller 300*a* should be operating in. The modes are self explanatory and the automatic mode will be further described below. Print start/stop switch 326 is also mounted on the face of the operator panel 300 for starting the automatic mode of printing. A reset button 328 is mounted on the control panel 300 for resetting several of the operations of the controller 300*a* as will be described below. An emergency stop button 330 is also mounted on the control panel 300 for stopping all of the functions of the printing press.

An air pressure low indicator 332 is also mounted on the control panel 300 as well as single print and double print LED indicators 350, 352 for each head, respectively. Also for each head, a manual head print button 334, a single/double/off switch 336, and front/rear stop switch 338 are all mounted on the operator panel 300. The single/double/off switch 336 puts each head into the correct mode for either manual operation or for programming the heads within the job cycles. The front/rear stop switch 338 places the heads in the front (outer) position or rear (inner) position for either manual operation or for operator programming. For each cycle, switches 336 and 338 are put in the appropriate positions or modes and the operator presses the enter button 320 to store information for that cycle as will be described in more detail below.

Referring to FIG. 20, the lower portion of the printing press is shown which includes the base 39, a support structure attached thereto, an indexing system for indexing the bed wheel or pallet assembly, and the pallet assembly. A main shaft 50 is mounted to the support structure and base 39. Encompassing the main shaft 50 is a lower bed arm hub 45 which integrally supports the bed arms 42 (not shown) together with bed arm supports 46 and hub rods 48. The bed arm supports 46 extend upwardly and outwardly from where they rest on the lower bed arm hub 45. The hub rods 48 extend between the lower bed arm hub 45and the upper bed arm hub 44 (see FIG. 16) and cause the hubs 44, 45 to squeeze the bed arm supports together with the beds arms 42 and bed wheel 40 to achieve an integral support arrangement. The full integral support arrangement including the hubs 44, 45, supports 46, rods 48, bed arms 42, and bed wheel 40 all revolve or rotate around the main shaft 50. In addition, this integral support assembly raises and lowers in unison.

Figure 21:
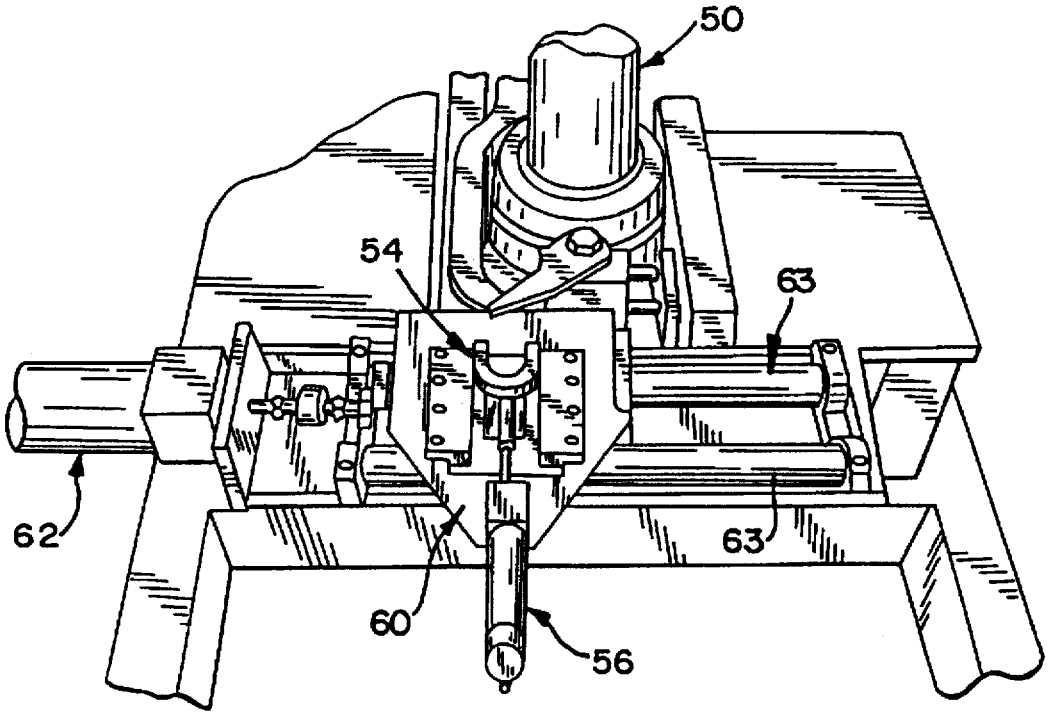
FIG. 21 is a perspective view of a part of the indexing apparatus of one embodiment of the present printing press with the bed or pallet assembly removed from view.

Disposed on the lower hub 45 are Index bearings 52 which are fixedly mounted beneath the lower hub 45. An index fork 54 is adapted to surround the bearing 52 for revolution indexing. Fork 54 is attached to an index fork cylinder 56 which is adapted to encompass and release bearing 52. Cylinder 56 is fixedly mounted on pillow 60 which is further fixedly mounted on two pillow blocks 58. The two pillow blocks 58 are adapted to slide on two shafts 63. An index shift cylinder 62 is mounted on the support structure attached to the base 39. Cylinder 62 is also attached to pillow 60 for stroking or indexing the pillow 60, and thus, bearing 52 when bearing 52 is encompassed within fork 54. Hence, the printing press beds 16 are adapted for indexing when bearing 52 is encompassed within fork 54 and cylinder 62 strokes or indexes pillow 60. In addition, three more proximity switches (detectors) are mounted on the printing press. Index off proximity switch 340 (not shown) is mounted on the base support structure and is provided for determining whether cylinder 62 is in its retracted position. Index on proximity switch 342 is mounted on the base support structure as well, and is provided for determining whether the beds 16 are properly aligned underneath the stations. Switch 342 is also used to determine if the beds 16 are in the down position. The last proximity switch is the lift on proximity switch 344 (not shown), is also mounted on the support structure and is provided for determining when the beds 16 are correctly aligned in the up position. Referring to FIG. 21, a perspective partial view of FIG. 20 is shown without the integral bed support assembly.

Referring to FIG. 22, controller 300*a* is shown being attached to a personal computer 400 for off-line programming. Preferably, the controller is a Mitsubishi FX-48MR (MELSEC) programmable controller with an FX-16EX Extension Block (see Mitsubishi Catalog Number K-C8024-B HI-9105 for programming specifications and other details). Software for programming the Mitsubishi controller can include the program MEDOC running on a personal computer. The following embodiment contains memory locations that start with different letters. For example, some of the memory locations are in the D200 to D300 range. Within the Mitsubishi controller specifications, these letters have significance in the memory capabilities and configuration as one of ordinary skill in the art would know.

Figure 23A:
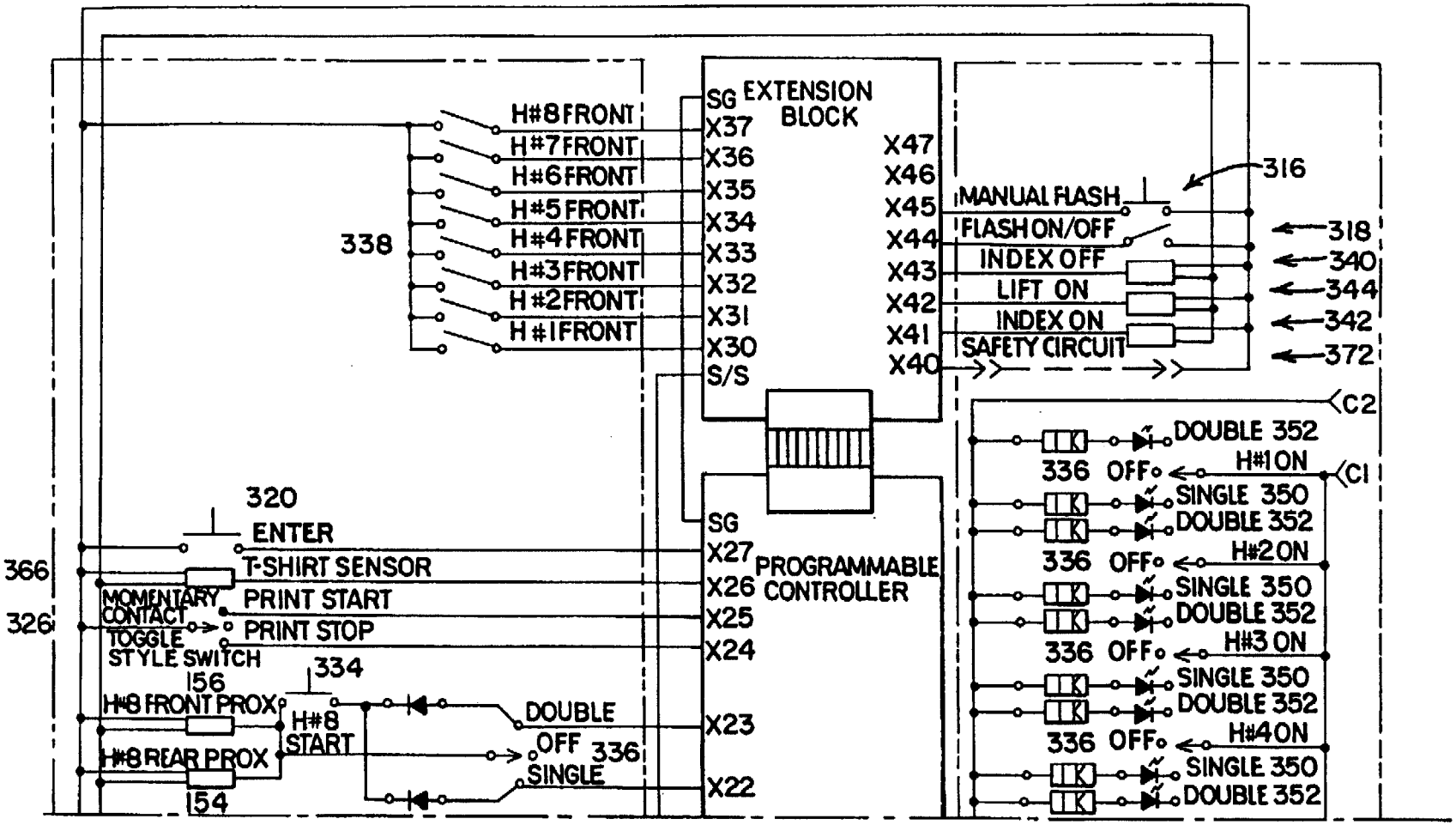
FIG. 23A–C are schematic diagram of one embodiment of the process controller with the connections to symbolic representations of the remaining portions of the printing press of the present invention.
Figure 23B:
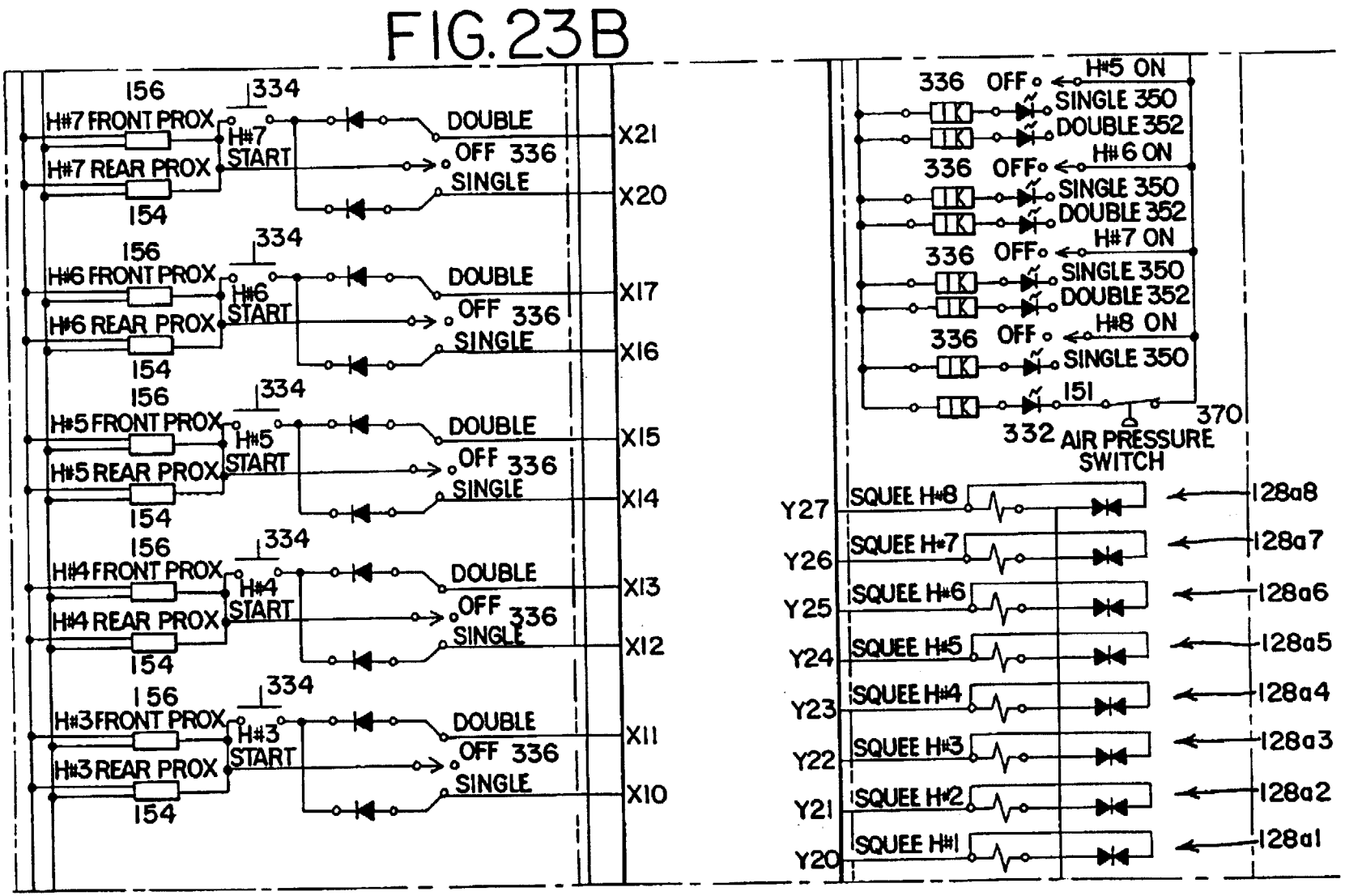
Figure 23C:
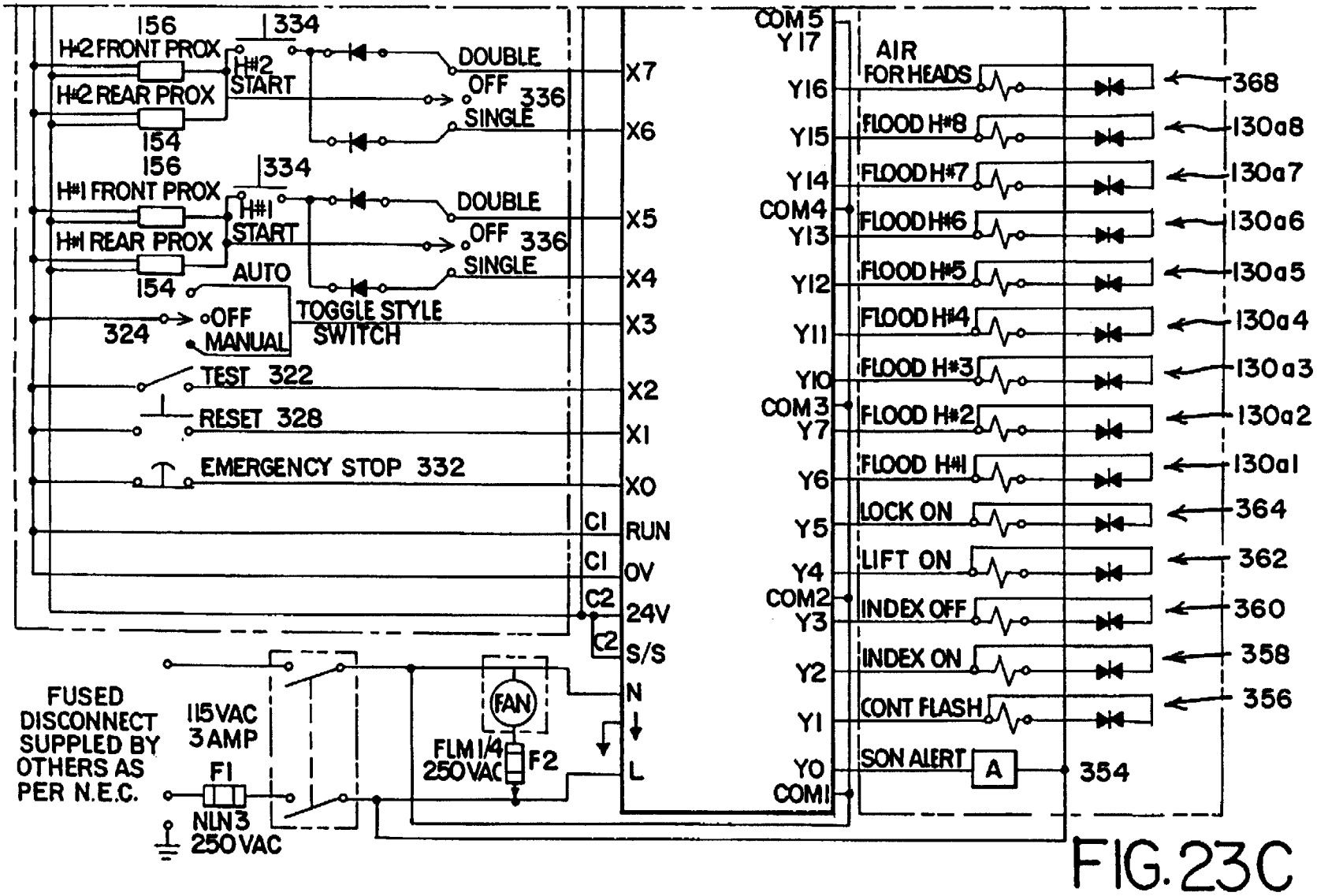

Referring to FIG. 23A–C, a schematic of the controller connections for one embodiment of the present invention is disclosed. X numbers designate inputs and Y numbers designate outputs. In addition, Squee H#_ stands for the squeegee valve at the head number listed, Flood H#_ stands for the flood valve at the head listed, and Prox stands for proximity switch (detector). One of ordinary skill in the art should be capable of understanding the controller specification in FIG. 23A–C when reference is made to the other Figures and the descriptions thereof.

FIGS. 24 through 37 are a flow chart of one embodiment of the present printing press control program that runs on the controller disclosed above, and will be explained below. The problems of the previous printing press listed in the Background of Invention section are solved with the present apparatus and sequencing system.

Figure 24:
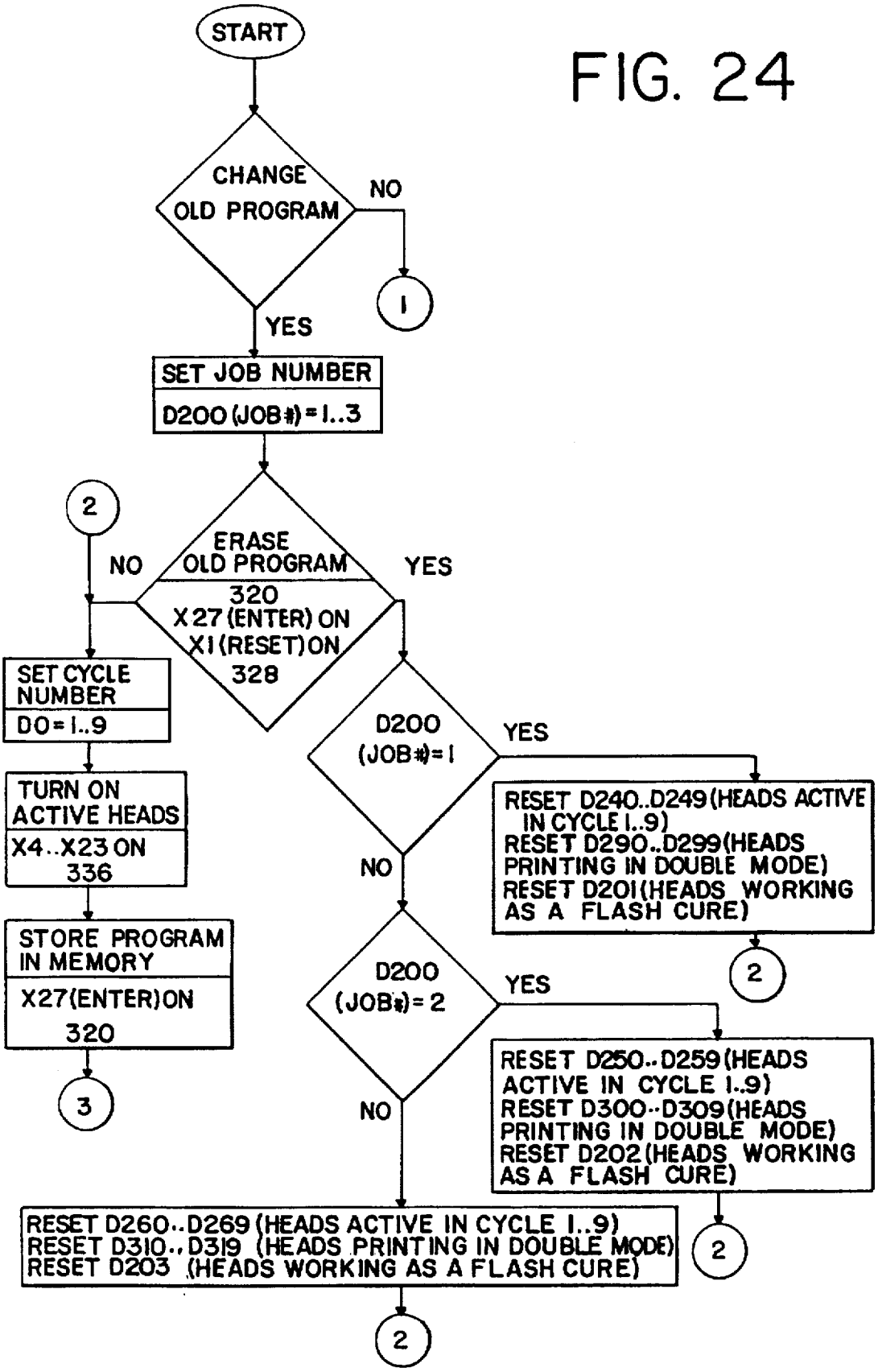
FIG. 24 is the first part of the master portion of a flow chart for one embodiment of the program that controls the process controller printing functions and operator entry for the same.
Figure 25:
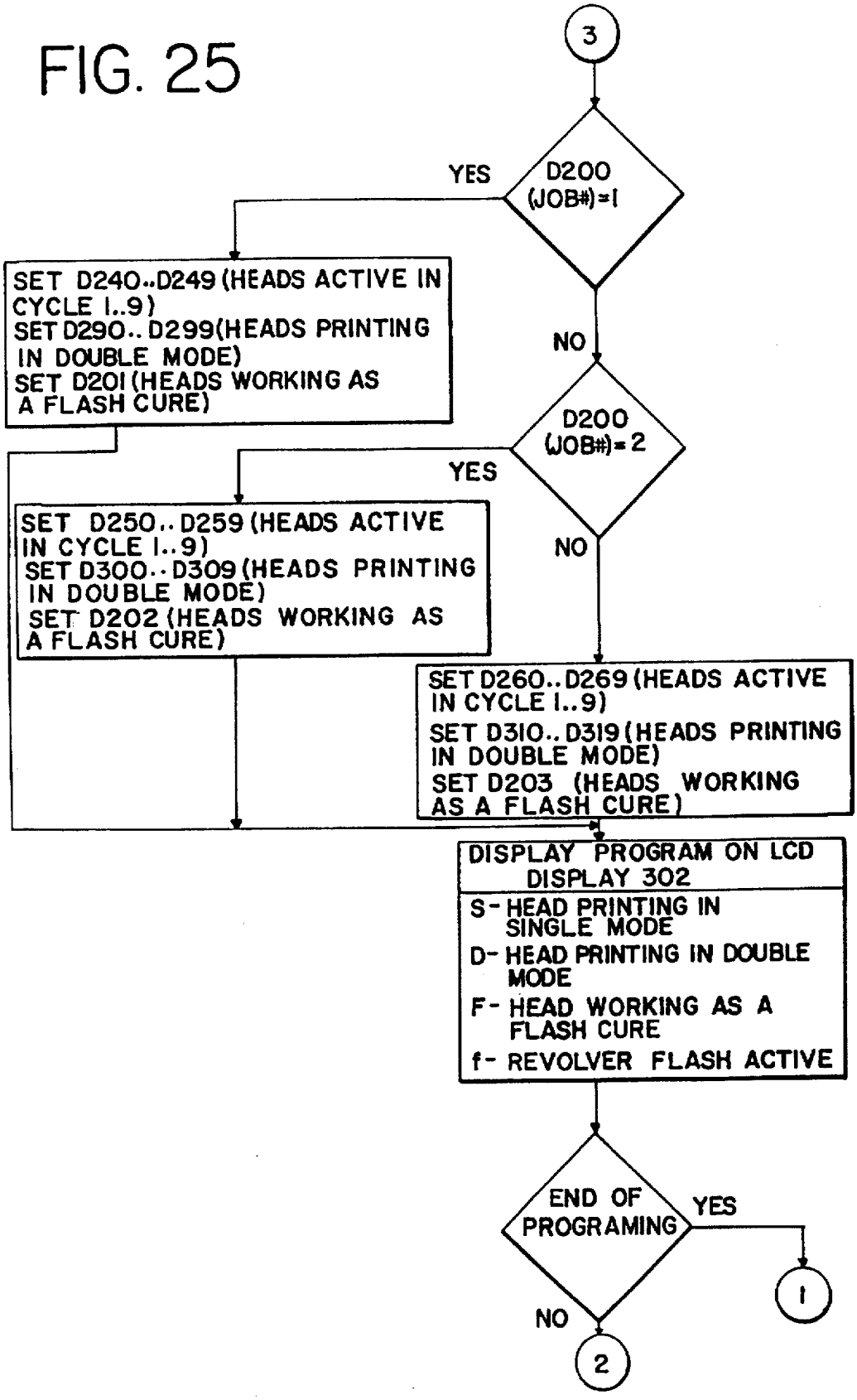
FIG. 25 is the second part of the master portion of a flow chart for one embodiment of the program that controls the process controller printing functions and operator entry for the same.

FIG. 24 begins a with control program allowing the operator or user to delete or modify the operator program. If the old program is not deleted or modified, the operator program then requests the user to choose a particular job to run. The particular embodiment disclosed herein allows an operator to choose, enter, or modify three separate jobs, each job including up to nine cycles in a ten station, eight head, printing press. If the operator wants to change an old operator program, the control program allows the operator to modify one or more cycles within each of the jobs (operator programs). A cycle is one revolution of the beds around the printing press while remembering that the printing press can only rotate in one direction. An alternative embodiment could allow for rotation in both directions if additional hardware and software were installed to sequence the system in both directions.

Continuing with FIG. 24, if a user wants to erase one of the old jobs, the heads (stations) stored as active, the heads printing in double mode, and the heads working as flash cure are reset. Specifically, certain locations in memory beginning with the letter D are reset for each job erased. Each job has its own area of memory. To only modify a job, a cycle number is chosen for the job and active head settings are set and then stored. Specifically, FIG. 25 discloses that heads active in the cycle chosen, heads printing in double mode for the cycle chosen, and heads working as flash cure for the cycle chosen are then stored in their specific memory locations. The M numbers are only further memory locations within RAM. Once new information is stored for the job and cycle being entered or modified, the new cycle within the job is displayed on the LCD display with the letters designated in FIG. 25. The operator can then choose to program more cycles or start a job.

Figure 26:
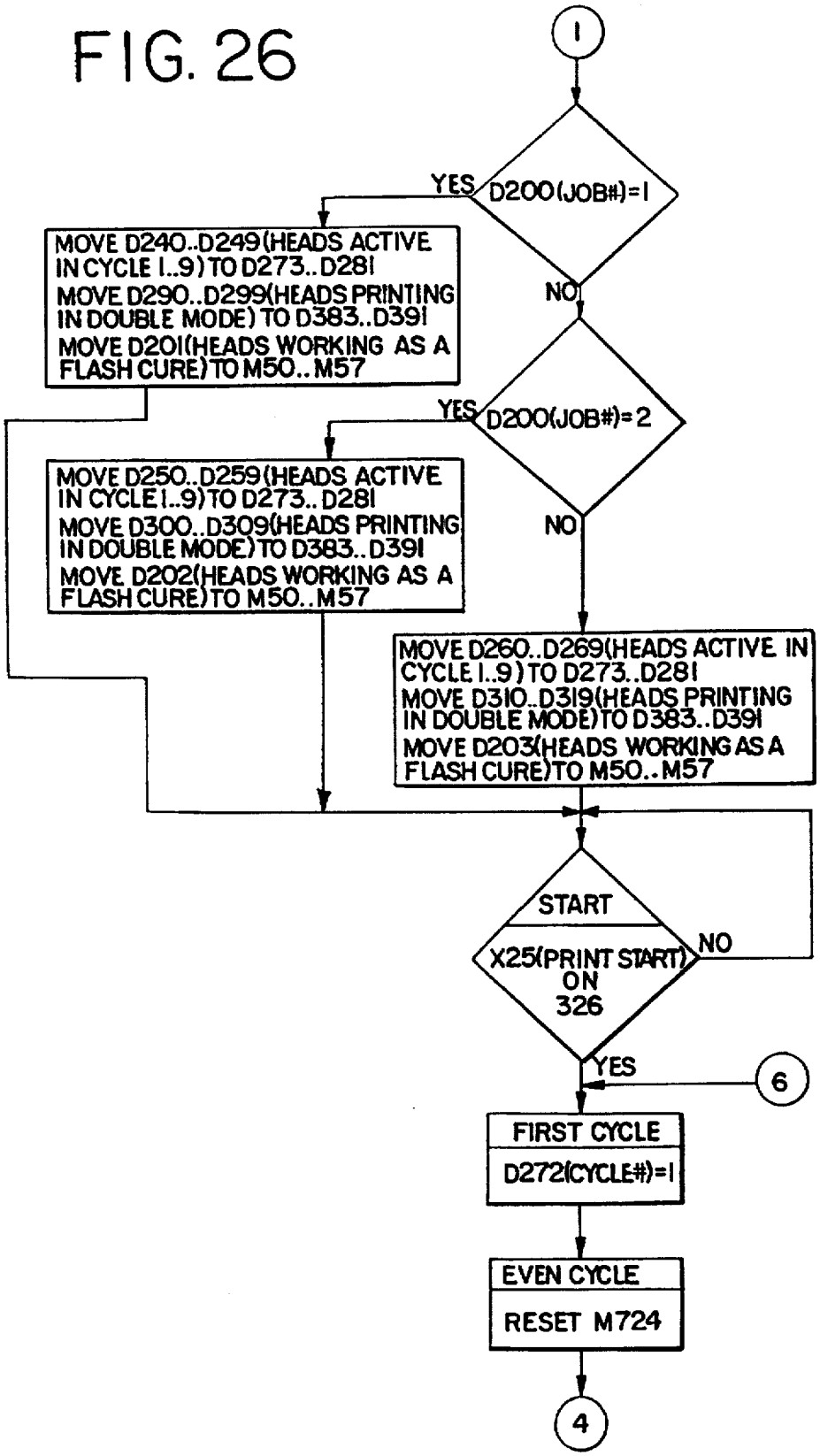
FIG. 26 is the second part of a sub-portion of a flow chart for one embodiment of the program that controls the process controller printing functions and operator entry for the same.

Referring to FIG. 26, to start a job, the operator must first choose a specific job. When the operator chooses a job, the information for that job is moved to a global job area in RAM The program then waits for the operator to start the print sequencing. Once the operator chooses to begin, the cycle memory location is set to one and the even cycle memory location is reset to odd.

Figure 27:
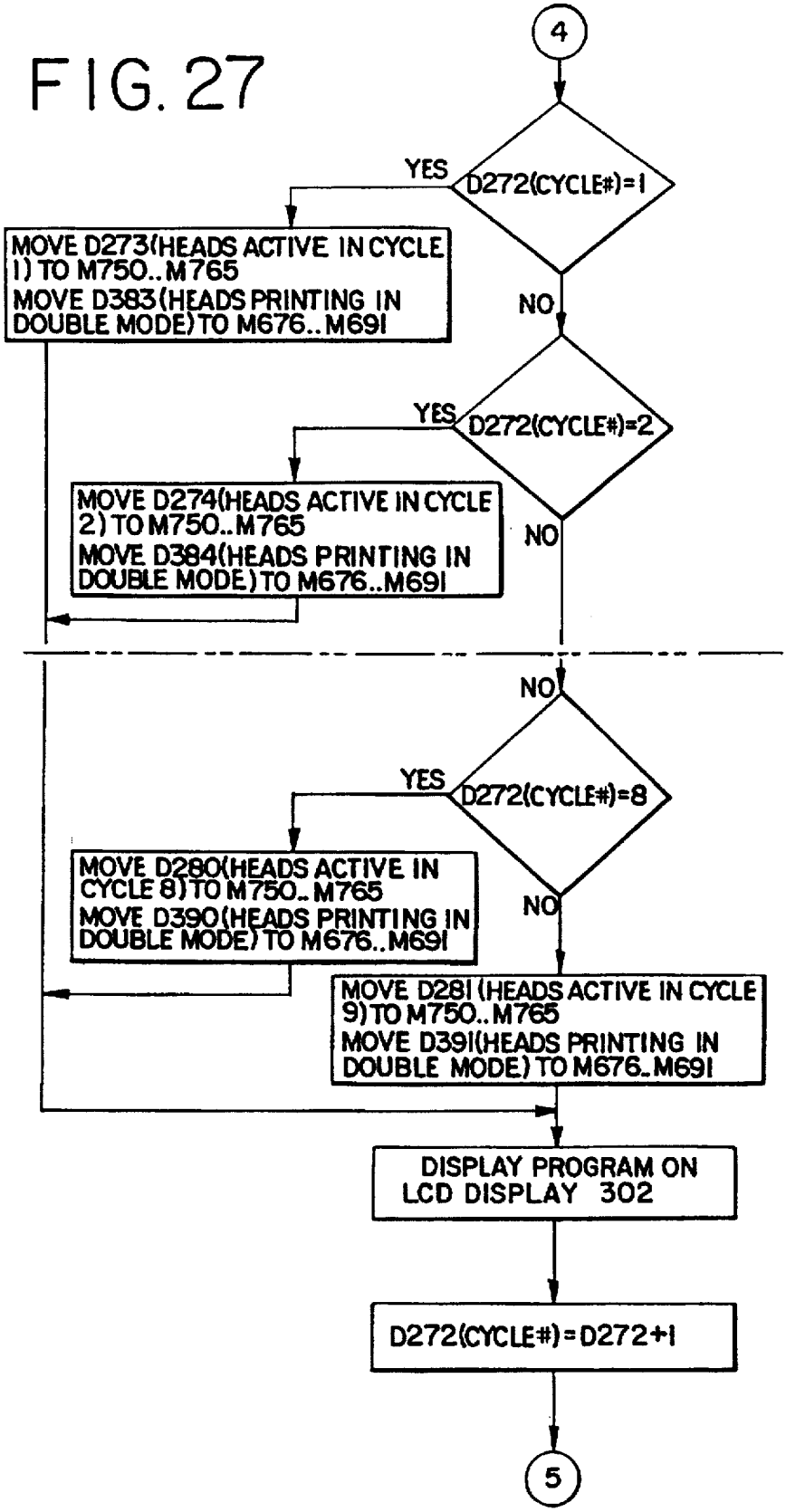
FIG. 27 is the third part of a sub-portion of a flow chart for one embodiment of the program that controls the process controller printing functions and operator entry for the same.

Referring to FIG. 27, information for the present cycle will be moved to a global cycle area in RAM (M numbers). The information for the present cycle is then displayed on the LCD display 302 and the cycle number memory location is incremented by one.

Figure 28:
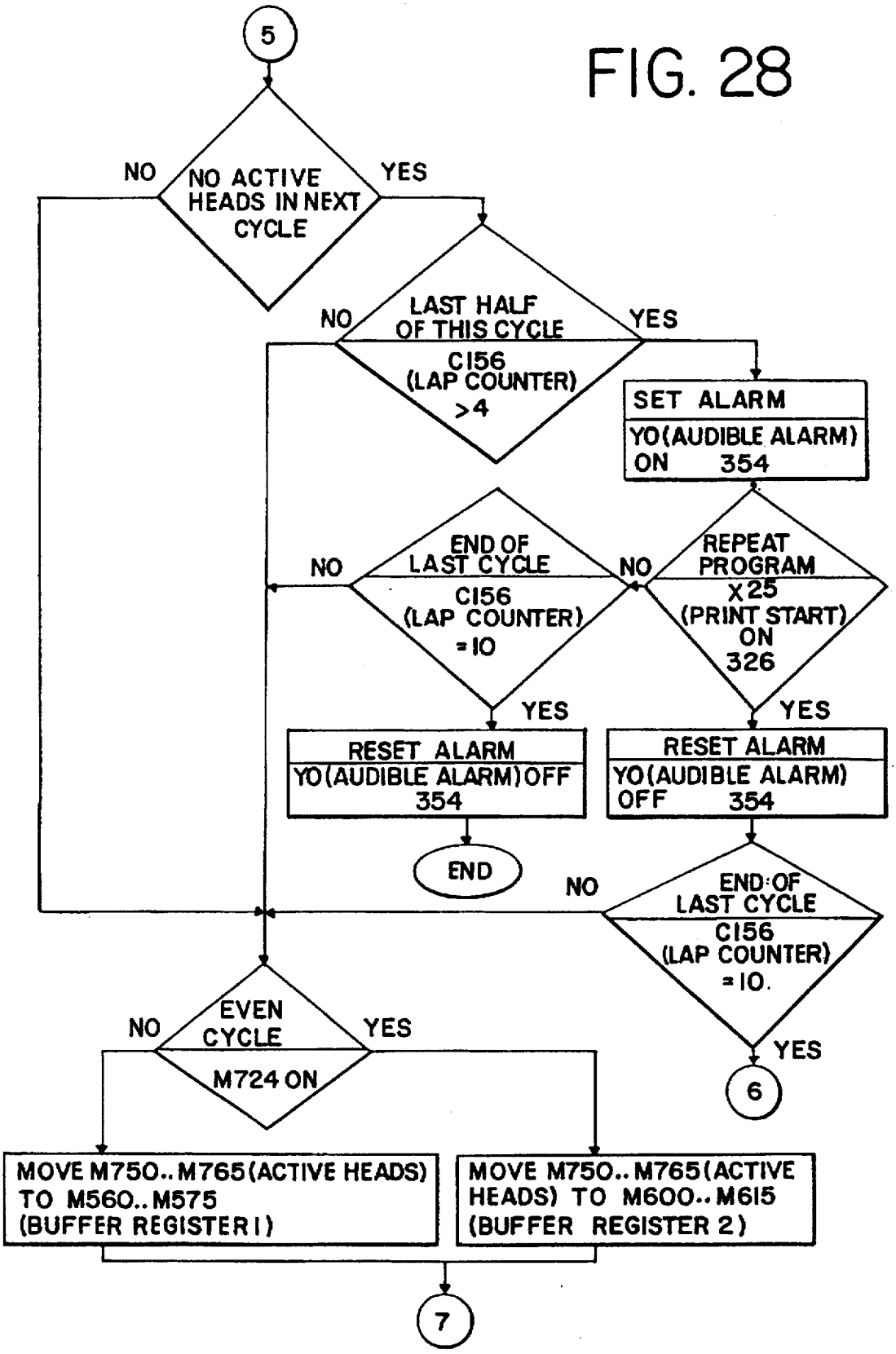
FIG. 28 is the fourth part of a sub-portion of a flow chart for one embodiment of the program that controls the process controller printing functions and operator entry for the same.

Referring to FIG. 28, a general check for the status of the cycles is performed. If there are no active heads in the next cycle, the present cycle is the last cycle. If this is the case, and the present cycle is half over, an audible alarm 354 is sounded to notify the operator to come back to the printing press for unloading. The lap counter is the position of the beds within a cycle relative to where the beds started at the beginning of that cycle. For a printing press that contained ten stations, one full lap would equal a lap counter value of ten. Checks are then done to see if the print start switch 326 is on the lap counter has attained a full revolution for the cycle.

Figure 38:
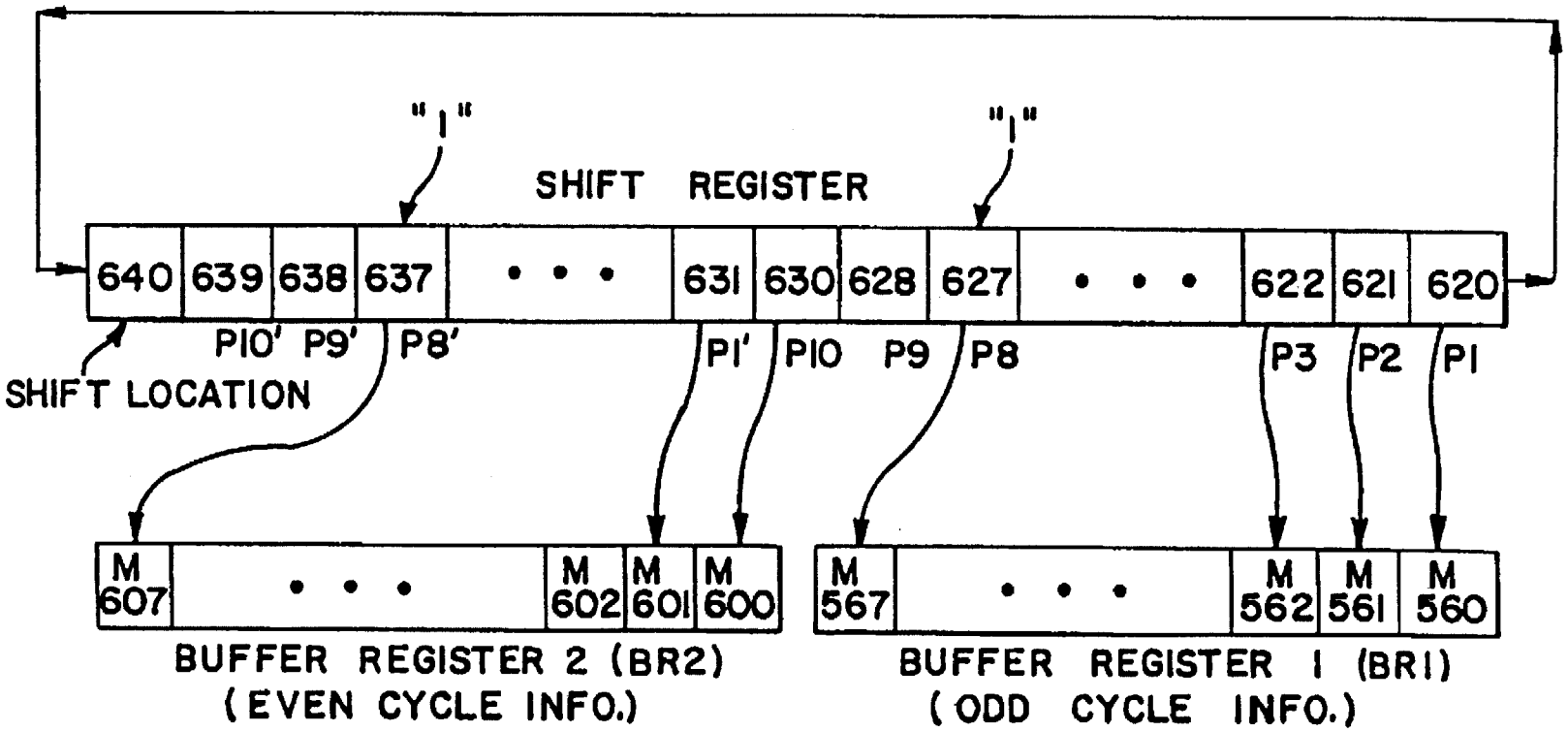
FIG. 38 is a part of the internal register and memory configuration for the program that controls the process controller printing functions and operator entry for the same.

Referring additionally to FIG. 38, a buffer and register configuration is used to keep track of active heads and the rotation of the beds or pallets 16. A first buffer BR1 (odd cycle buffer) and a second buffer BR2 (even cycle buffer) are disclosed for storing the information for the odd and even cycles, respectively. A shift register is used to keep track of the position of the beds during each of the cycles (lap counter value in relation to bed position). As FIG. 28 discloses, if the cycle is odd, the active/inactive head information for the present cycle will be placed into BR1. Likewise,if the cycle is even, the active/inactive head information for the present cycle will be placed into BR2. Thus, information for two cycles will be in BR1 and BR2 for the circumstance when some of the heads are operating within one cycle, while the other heads are operating within another cycle. It will be understood that not more than two cycles will be operating at the same time. These buffers and register will be described in further detail below.

Figure 29:
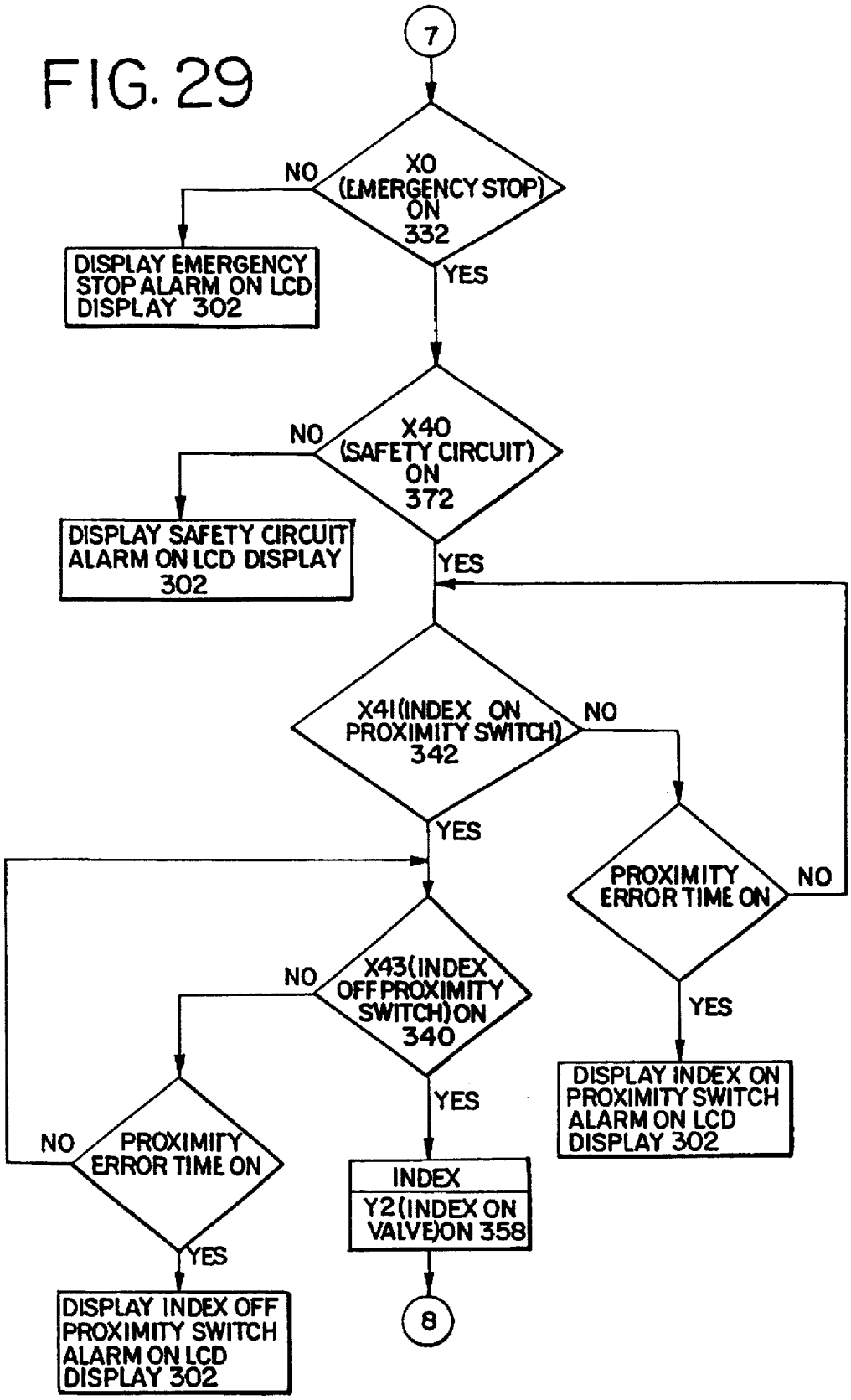
FIG. 29 is the fifth part of a sub-portion of a flow chart for one embodiment of the program that controls the process controller printing functions and operator entry for the same.

Referring to FIG. 29, an emergency stop button 332 will be continuously checked along with a safety circuit 372, 70 (see FIG. 16) along the perimeter of the printing press. If there is an indication of these safety features not being in the safe condition, the machine will stop and an alarm indicator will appear on the operator control panel 300 LCD display 302. An index on proximity switch (detector) exists on the support structure assembly to determine if the beds are positioned correctly underneath the stations and to determine if the pallets 16 are in the down position. If not, then a timer will wait until the correct alignment exists or it will time out into an alarm mode. If the correct rotation alignment exists, then an index off proximity switch is checked to see if cylinders 56 and 62 are in the correct positions for indexing. If the index off proximity switch 340 is off, then a timer starts which will time out into alarm mode if enough time passed without a change in state. Once the alignment and orientation are correct, the beds are indexed by turning the index on valve 358 on which rotates the beds in one (usually counter-clockwise) direction.

Figure 30:
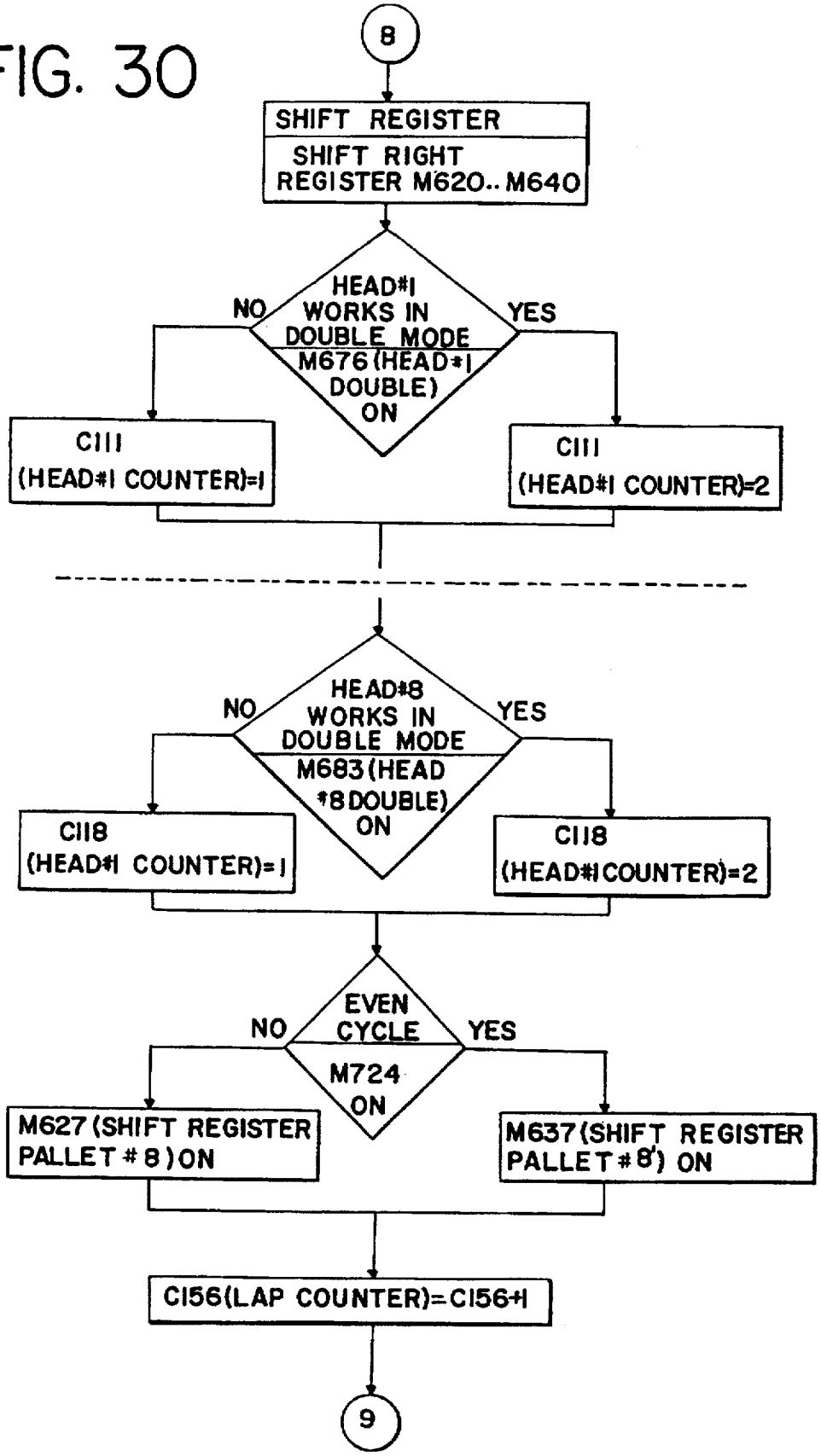
FIG. 30 is the sixth part of a sub-portion of a flow chart for one embodiment of the program that controls the process controller printing functions and operator entry for the same.

Referring to FIG. 30 and FIG. 38, the Shift Register is then shifted right to keep track of the position of the beds within the cycles currently placed into the buffer registers BF1, BF2. Next, the control program checks which of the heads (stations) are set up in the operator program to operate as double print mode. Double print mode strokes the flood bar, strokes the squeegee, and then repeats the flood and squeegee again. Double print mode heads will create head counter values of two and non-double print mode heads will create head counter values of one for single print mode. C RAM memory locations are used for the head counters. Once the head counters are set to their respective values, a one is then placed into the eighth pallet position (the pallet which first started in the loading station) to keep track of the positions of the pallets or beds for the relevant cycles (see FIG. 38). The eighth pallet position register (shift register pallet) location used will depend on whether the current cycle is an odd cycle or an even cycle. If even, the eighth prime shift register pallet M637 will be set to one. If odd, the eighth shift register pallet M 627 will be set to one. The lap counter C156 is then incremented by one to keep track of the position of the bed (pallet) wheel around the printing press for the current cycle.

Figure 32:
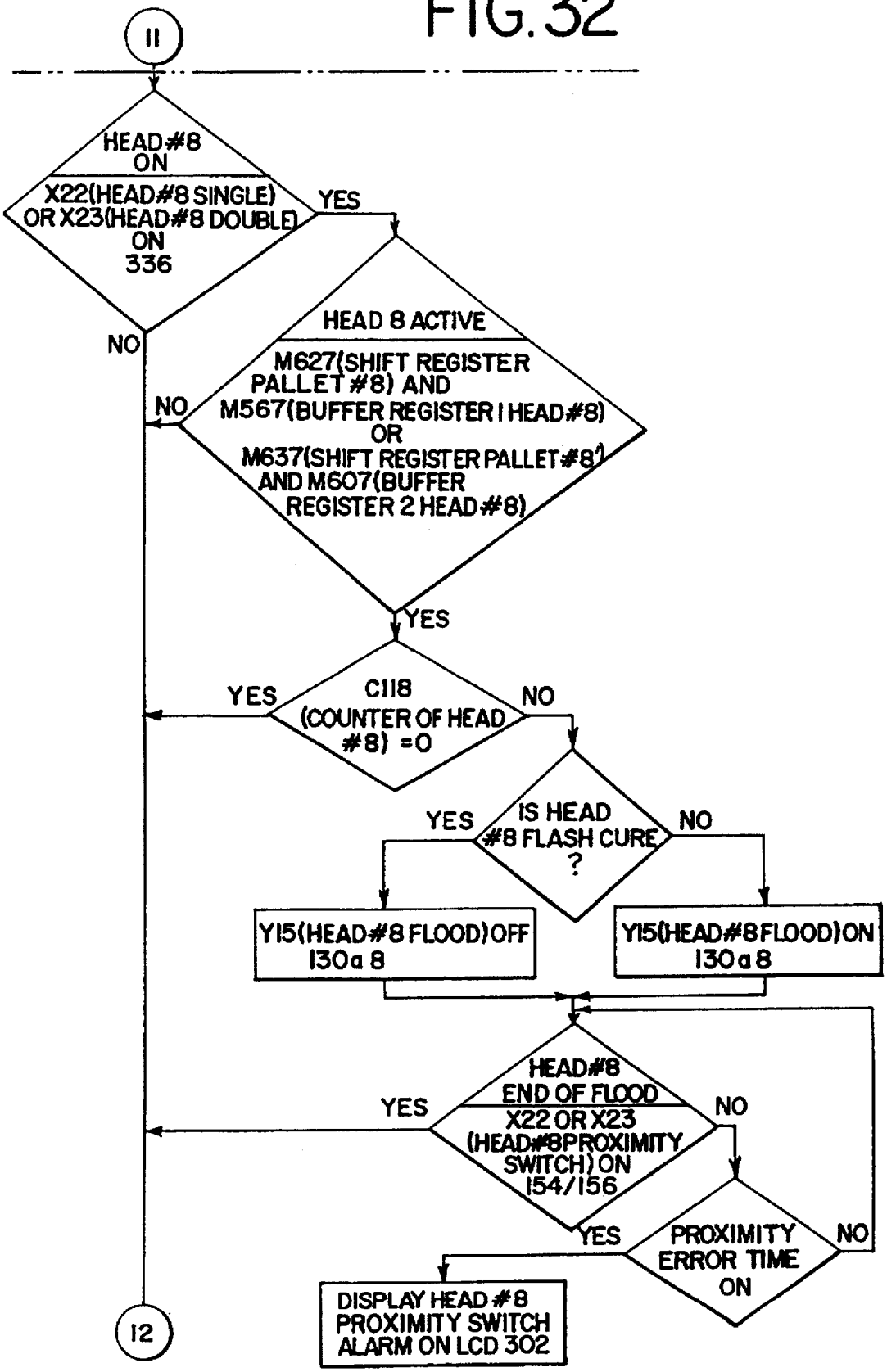
FIG. 32 is the eighth part of a sub-portion of a flow chart for one embodiment of the program that controls the process controller printing functions and operator entry for the same.

Referring to FIG. 31, the checks for each head begin. First, a check is performed to determine whether head one is in single or double mode, or is altogether off. If single or double mode is set, then a check is performed to see if head one is active in the buffers and registers. If head one is active and counter is not zero, either curing or flooding will occur, depending on whether head one is set up for flash curing in memory for this cycle. The proximity switches are then checked to see if the flooding or curing stroke is completed. Referring to FIG. 32, the same tests and sequencing as FIG. 31 are then performed for the remaining heads.

Referring to FIG. 33, the operation of a curing station at the unload station (revolver flash curing station) is disclosed.

When the control panel flash on/off switch 318 is on, the revolver flash will be set on if the buffer and register values indicate an active value. Once the revolver curing is checked, the index on switch 342 is checked to see if the pallets 16 are down and properly aligned. If switch 342 is on, the pallets 16 are then lifted into the up position. When the lift on proximity switch/detector 344 is on, the indexing cylinder 62 (index on 358) which rotates the bed wheel is brought back to receive the next bearing 52 underneath the next pallet 16. Error time alarms are also provided. The printing press sequencing is now ready for the squeegee operation.

Figure 35:
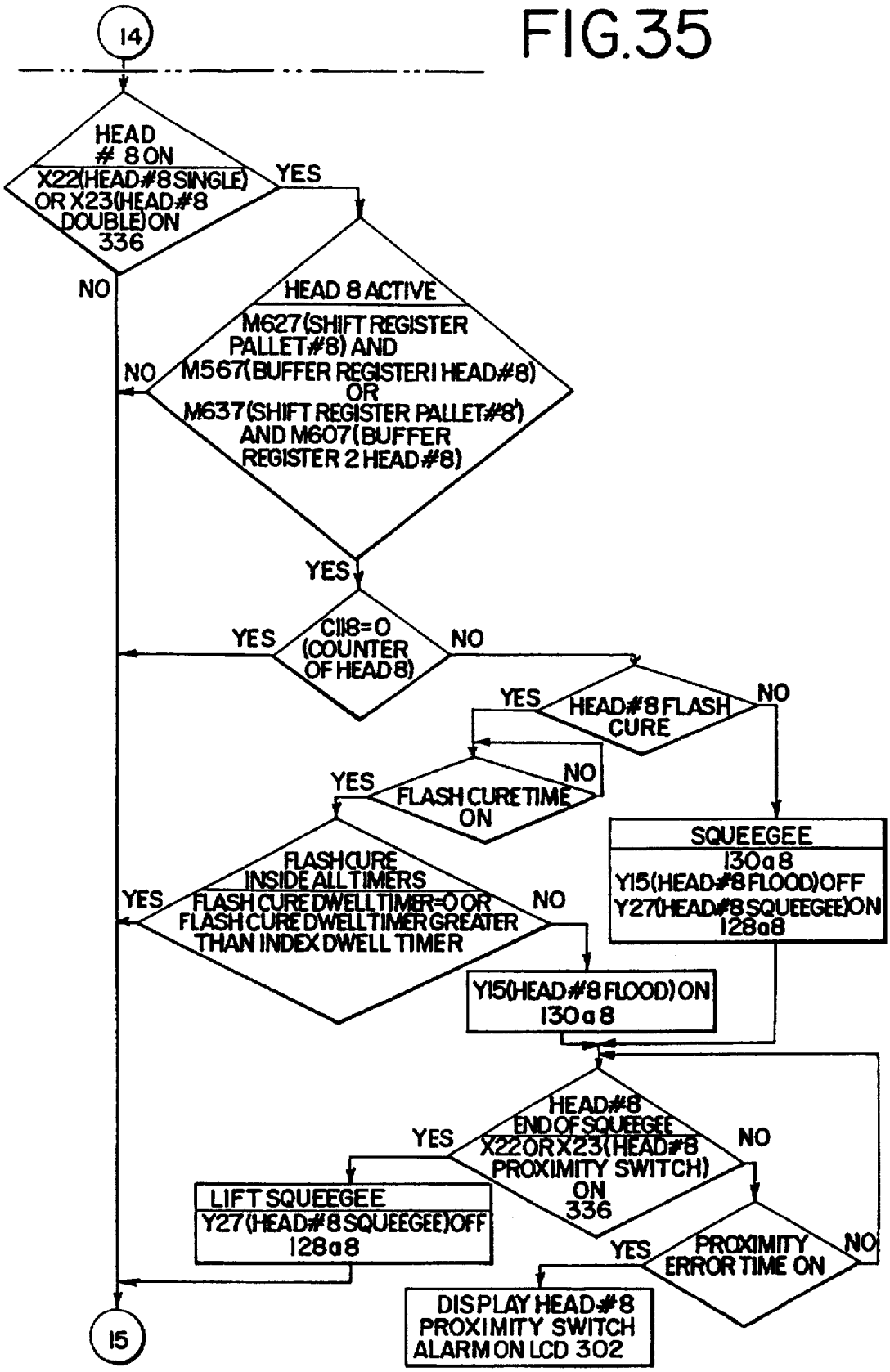
FIG. 35 is the eleventh part of a sub-portion of a flow chart for one embodiment of the program that controls the process controller printing functions and operator entry for the same.

Referring to FIG. 34, head one is again checked to see if it is set up in double or single mode, or is altogether off. If single or double mode is set, the buffer and shift registers are checked for head one to see if head one is active. If head one is active and the head counter is not zero, squeegee will occur if head one is not set up as a flash cure. Otherwise, flash curing will take place until the flash cure dwell timer is zero or until the flash cure dwell timer is greater than the index dwell timer. These dwell timers are settable by the operator in software and can be modified to fit the user's needs for curing. For the squeegee operation, the squeegee is then lifted when either of the proximity switches 154, 156, 336 at station one has detected the head portion. Other features are apparent from the flowchart. Referring to FIG. 35, the same tests and sequencing as FIG. 34 are then performed for the remaining heads.

Figure 36:
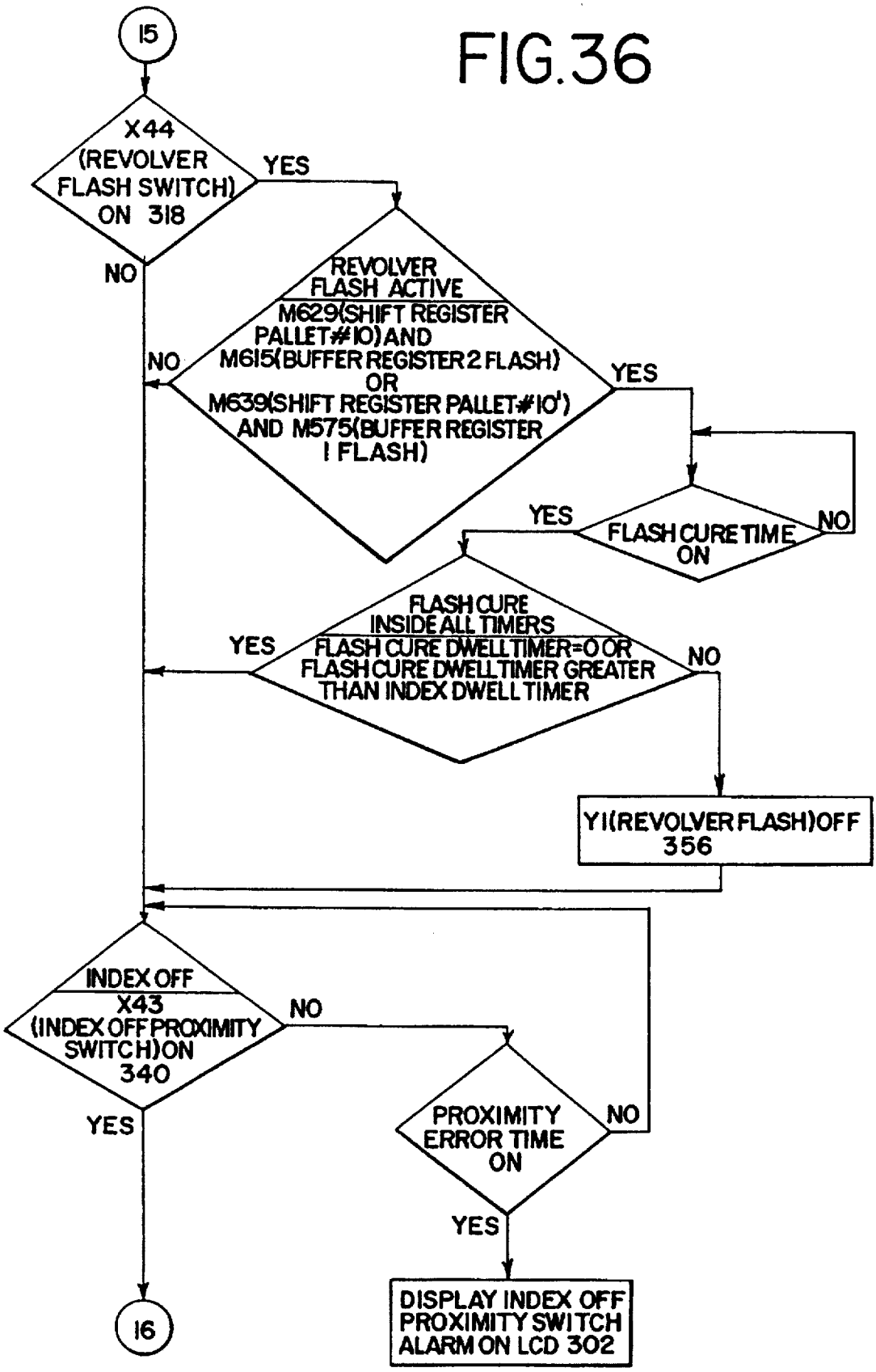
FIG. 36 is the twelfth part of a sub-portion of a flow chart for one embodiment of the program that controls the process controller printing functions and operator entry for the same.

Referring to FIG. 36, a check is then performed to see if the revolver flash cure switch 318 is set on. If yes, then the buffer and shift registers are checked to see if the revolver flash is active. The curing at station nine then takes place, if station nine is active, for the times designated in the dwell timers. Indexing is then continued by checking if the index off proximity switch 340 is on.

Figure 37:
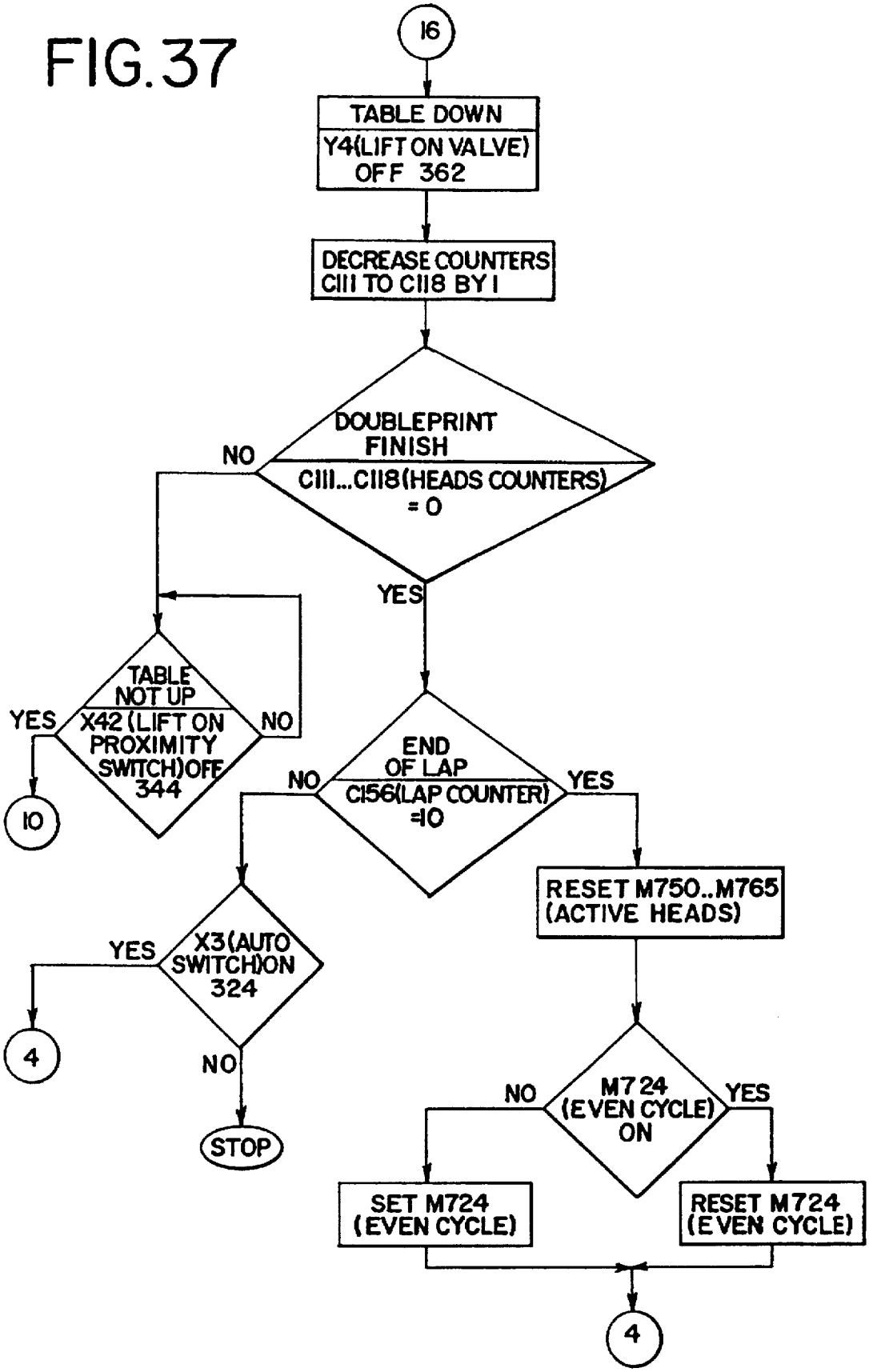
FIG. 37 is the thirteenth part of a sub-portion of a flow chart for one embodiment of the program that controls the process controller printing functions and operator entry for the same.

Referring to FIG. 37, if the index off proximity switch 340 is on (the fork 54 is aligned to accept the bearing 52), then the pallets 16 are lowered and all of the head counters are decremented by one. If any one of the head counters is greater than one at this point, at least one of the heads is set up as double print mode and another flooding and squeegeeing operation needs to be performed for those heads. The table would then be raised for those double print heads before the strokes occur. If all head counters are zero, printing is complete for this position and the lap counter is then checked to see if the cycle is over. If the lap counter is less than ten and the system is still set on automatic mode, the system then begins the next position within the current cycle. Otherwise, if the counter equals ten, the present cycle is complete and the active heads are reset for the present cycle. The even cycle on is then set odd, if even, and set even, if odd, for movement of the appropriate cycle information into the appropriate buffer register as the flow chart discloses in conjunction with FIG. 38. The sequencing then continues on.

While the specific embodiments have been illustrated and described, numerous modifications come to mind without significantly departing from the spirit of the invention, and the scope of protection is only limited by the scope of the accompanying claims.

We claim:

1. A method of controlling a printing press having a plurality of stations, wherein each of the stations is capable of working as a print station for printing ink onto an item, and wherein each of the stations is also capable of operating as a curing station for curing the ink printed on the item, the method comprising the steps of:

entering a set of instructions for automatically sequencing the printing press, wherein the set of instructions includes setting the stations as active or inactive and setting the active stations as printing stations or curing stations;

running the set of instructions; and, manually preventing one of the active stations from operating during automatic sequencing without erasing the set of instructions for automatic sequencing.

2. The method of claim 1 wherein a plurality of active/inactive switches are used to manually prevent one of the active stations from operating during automatic sequencing.

3. The method of claim 1 further comprising the step of displaying the active and inactive stations.

4. The method of claim 3 wherein the active and inactive stations are displayed for each cycle.

5. The method of claim 1 wherein the set of instructions is entered into a controller.

6. The method of claim 5 wherein the controller is adapted to store the set of instructions.

7. The method of claim 6 wherein the controller is adapted to store more than one set of instructions.

8. The method of claim 7 further comprising the step of choosing one of the stored sets of instructions for automatically sequencing the printing press.

9. The method of claim 1 further comprising the step of storing the set of instructions.

10. The method of claim 9 further comprising the step of storing more than one set of instructions.

11. The method of claim 10 further comprising the step of choosing one of the stored set of instructions for automatically sequencing the printing press.

12. The method of claim 1 wherein each printing station prints the ink onto the item, either from a first print position to a second print position, or from the second print position to the first print position.

13. The method of claim 12 wherein a plurality of front/rear switches place each printing station either in the first print position or in the second print position.

14. The method of claim 12 further comprising the step of adjusting the first and second print positions.

15. The method of claim 1 wherein each curing station cures the ink on the item, either from a first curing position to a second curing position, or from the second curing position to the first curing position.

16. The method of claim 15 wherein a plurality of front/rear switches place each curing station either in the first curing position or in the second curing position.

17. The method of claim 15 further comprising the step of adjusting the first and second curing positions.

18. The method of claim 1 wherein each inactive station remains at an outer position.

19. The method of claim 1 wherein a flooder and a squeegee print ink onto the item.

20. The method of claim 1 further comprising the step of flashing infrared light on the item to cure the ink printed on the item.

21. The method of claim 1 wherein the instructions include setting each print station in a single print mode or a double print mode.

22. The method of claim 1 wherein all of the stations are adapted to operate as curing stations.

23. A method of controlling a printing press having a plurality of stations, wherein each of the stations is capable of working as a print station for printing ink onto an item, and wherein each of the stations is also capable of operating as a curing station for curing the ink printed on the item, the method comprising the steps of:

choosing a set of instructions for automatically sequencing the printing press, wherein the set of instructions includes setting the stations as active or inactive and setting the active stations as printing stations or curing stations;

running the set of instructions; and, manually preventing one of the active stations from operating during automatic sequencing without erasing the set of instructions for automatic sequencing.

24. The method of claim 23 wherein a plurality of active/inactive switches are used to manually prevent one of the active stations from operating during automatic sequencing.

25. The method of claim 23 further comprising the step of displaying the active and inactive stations.

26. The method of claim 25 wherein the active and inactive stations are displayed for each cycle.

27. The method of claim 23 wherein the set of instructions is chosen from a controller.

28. The method of claim 27 wherein the controller is adapted to store more than one set of instructions.

29. The method of claim 23 further comprising the step of modifying the set of instructions for automatically sequencing the printing press.

30. The method of claim 29 further comprising the step of storing the modified set of instructions.

31. The method of claim 23 wherein each printing station prints the ink onto the item, either from a first print position to a second print position, or from the second print position to the first print position.

32. The method of claim 31 wherein a plurality of front/rear switches place each printing station either in the first print position or in the second print position.

33. The method of claim 31 further comprising the step of adjusting the first and second print positions.

34. The method of claim 23 wherein each curing station cures the ink on the item, either from a first curing position to a second curing position, or from the second curing position to the first curing position.

35. The method of claim 34 wherein a plurality of front/rear switches place each curing station either in the first curing position or in the second curing position.

36. The method of claim 34 further comprising the step of adjusting the first and second curing positions.

37. The method of claim 23 wherein each inactive station remains at an outer position.

38. The method of claim 23 wherein a flooder and a squeegee print ink onto the item.

39. The method of claim 23 further comprising the step of flashing infrared light on the item to cure the ink printed on the item.

40. The method of claim 23 wherein the instructions include setting each print station in a single print mode or a double print mode.

41. The method of claim 23 wherein all of the stations are adapted to operate as curing stations.

* * * * *